US008297427B2

(12) United States Patent
Oie et al.

(10) Patent No.: US 8,297,427 B2
(45) Date of Patent: Oct. 30, 2012

(54) BANKNOTE HANDLING APPARATUS

(75) Inventors: Yoshiro Oie, Tokyo-To (JP); Hiroshi Tone, Tokyo-To (JP); Ryuichi Tabata, Yokohama (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 633 days.

(21) Appl. No.: 11/887,071

(22) PCT Filed: Mar. 29, 2005

(86) PCT No.: PCT/JP2005/005854

§ 371 (c)(1),
(2), (4) Date: Jan. 15, 2009

(87) PCT Pub. No.: WO2006/106563

PCT Pub. Date: Oct. 12, 2006

(65) Prior Publication Data

US 2009/0211874 A1 Aug. 27, 2009

(51) Int. Cl.
*G07F 7/04* (2006.01)

(52) U.S. Cl. ..... 194/206; 194/344; 271/3.21

(58) Field of Classification Search ..... 194/206, 194/344, 346; 235/379, 381, 385; 209/534; 902/7, 9, 12, 13; 271/3.21, 3.22, 10.08, 304
See application file for complete search history.

(56) References Cited

FOREIGN PATENT DOCUMENTS

| | | |
|---|---|---|
| JP | 1-187150 | 7/1989 |
| JP | 3-172270 | 7/1991 |
| JP | 8-198507 | 8/1996 |
| JP | 11-334967 | 12/1999 |
| JP | 2003-288630 | 10/2003 |
| JP | 2003-288630 A * | 10/2003 |
| JP | 2003-341943 | 12/2003 |
| JP | 2004-231384 | 8/2004 |

OTHER PUBLICATIONS

PCT Notification of Transmittal of Translation of the International Preliminary Examination Report (Form PCT/IB/338) dated Jan. 2004.
PCT International Preliminary Report on Patentability (Form PCT/IB/373) dated Jan. 2004.
Translation of Written Opinion of the International Searching Authority (PCT/ISA/237) dated Jan. 2004.
Office Action issued in corresponding Japanese Application No. 2003-023608 dated Feb. 8, 2008 (in Japanese).
Supplementary European Search Report issued Jun. 7, 2010 for Application No. EP 05 72 7590.

* cited by examiner

*Primary Examiner* — Mark Beauchaine
(74) *Attorney, Agent, or Firm* — Smith, Gambrell & Russell, LLP

(57) ABSTRACT

A banknote handling apparatus includes multiple units each for banknote receiving, disbursing, and the like, and a conveyance drum. Multiple pressure rollers are each pressed against an outer surface of the drum. A circling route for banknote conveyance, having a discrimination sensor, is formed around the outer surface of the drum. The units are connected to the circling conveyance route by their respective interconnecting route for banknote conveyance. A route changer is provided for conducting route changes from the circling conveyance route to each interconnecting conveyance route, and vice versa. A rotational direction of a rotary drum during the conveyance of a banknote into either of the units, and a rotational direction of the drum during the conveyance of a banknote into either of the units arranged at an opposite side from the units in a diametral direction of the conveyance drum, are also made opposite to each other.

10 Claims, 12 Drawing Sheets

BANKNOTE HANDLING APPARATUS

TECHNICAL FIELD

The present invention relates to a banknote handling apparatus for receiving and disbursing banknotes, the apparatus having a sensor on a banknote conveyance route to discriminate denominations of the banknotes.

BACKGROUND ART

Such a banknote handling apparatus is usually constructed so as to convey banknotes to a storage unit or the like by means of a stretched elastic belt. For example, JP-A-2001-143128 relating to the applicant for the present invention discloses means for conveying banknotes by using a belt linearly stretched between pulleys of substantially the same diameter.

The conventional banknote handling apparatuses using such a belt type of conveyance means have the problems below.

First, there is a need to drive the conveyance belt while applying tension to a level at which is obtainable a gripping force that does not cause slipping of the banknote conveyed. Driving the elastic belt in defiance of such a tensile load requires a very high-output driving device, such as a motor. Accordingly, the driving device needs to be dimensionally large, which makes it difficult to miniaturize the entire apparatus.

Next, to discriminate denominations of a banknote on the conveyance route, the discrimination sensor (e.g., optical sensor) installed thereon must be positioned so that the banknote moves past the sensor over the entire length thereof. This means imposing the requirement that the length of the banknote conveyance route between the discrimination sensor and the storage unit be greater than the length (longitudinal dimension) of the "longest banknote" in the apparatus. Adoption of the banknote conveyance means using a linearly stretched elastic belt, however, involves linear conveyance routing as well. To satisfy the above requirement, therefore, a considerable deal of space is required and as a result, a dead space becomes prone to occur in the apparatus. This is another factor that makes the miniaturization of the entire apparatus difficult.

One possible countermeasure against these problems would be to dispose the elastic belt in bent form, not in linearly stretched form. In that case, however, the elastic belt needs supporting in bent form by using a number of idler rollers or the like, which will increase not only costs, but also conveyance loads, thus resulting in a further dimensional increase in the driving device. Therefore, this countermeasure is not necessarily effective.

DISCLOSURE OF THE INVENTION

The present invention has been made in consideration of the above, and an object of the invention is to provide such a banknote-handling apparatus that can be totally miniaturized, compared with the foregoing conventional apparatus.

In order to accomplish the object, there is provided a banknote handling apparatus comprising:

a conveyance drum having a circumferential length greater than a length of a longest one of all kinds of banknotes to be handled;

a rotary driving device configured to rotate the conveyance drum in both forward and reverse directions;

a plurality of pressure rollers spaced in a circumferential direction of the conveyance drum, each of the rollers being pressed against an outer surface of the drum;

a circling guide member formed around the outer surface of the conveyance drum, the circling guide member forming a circling conveyance route between the drum and the guide member;

a discrimination sensor provided on the circling conveyance route, the discrimination sensor being configured to discriminate denominations of the banknote moved past the sensor;

a banknote introduction unit into which a received banknote is introduced:

a plurality of banknote storage units each for accommodating the received banknote of corresponding one or more of denominations;

a banknote release unit configured to release the banknote removed from at least one of the storage units in preparation for disbursement;

a banknote collection unit for accommodating the banknote collected from at least one of the storage units;

a reject unit for accommodating, of all the received banknotes and all the banknotes to be disbursed, only a banknote to be rejected as unacceptable one;

interconnecting guide members forming interconnecting conveyance routes connected between the circling conveyance route and the introduction unit, the storage units, the release unit, the collection unit, and the reject unit, respectively to convey a banknote therebetween;

a route changer configured to change an actual banknote conveyance route from/to the circling conveyance route to/from any one of the interconnecting conveyance routes; and a control unit configured to control at least the rotary driving device and the route changer;

wherein:

the introduction unit, the release unit, the collection unit, and the reject unit are arranged at an opposite side from the storage units with respect to the conveyance drum in a diametral direction of the conveyance drum; and the control unit is further configured to control the rotary driving device such that:

(i) when feeding the banknote into any one of the storage units, the driving device rotates the conveyance drum in the forward direction, and (ii) when feeding the banknote into any one of the release unit, the collection unit, and the reject unit, the driving device rotates the conveyance drum in the reverse direction.

Rotating the conveyance drum by means of the rotary driving device allows the present banknote-handling apparatus to convey a banknote along the circling conveyance route while supporting the banknote in sandwiched form between the conveyance drum and the pressure rollers. Also, denominations of the banknote conveyed along the circling conveyance route can be discriminated by using the discrimination sensor. In addition, the banknote can be selectively conveyed between the introduction unit, each storage unit, the release unit, the collection unit, and the reject unit, by changing the actual conveyance route of the banknote from/to the circling conveyance route to/from any one of the interconnecting conveyance routes, or vice versa, via the route changer.

Conveying banknotes in this manner by using the conveyance drum and the pressure rollers does not cause such a tensile load as applied in the belt type of conveyance means, and eliminates the necessity of using the high-output driving device employed in the conventional apparatus. In addition, regarding the requirement that the length of the conveyance route between the discrimination sensor and the storage unit be greater than the length of the "longest banknote" conveyed, banknote discrimination with the discrimination sensor in the annular circling conveyance route allows an internal space of the apparatus to be used more effectively than the conventional discrimination of banknotes in the linear conveyance route. Compared with the conventional apparatus, therefore, the apparatus according to the present invention allows the miniaturization of the entire apparatus by adopting a dimensionally reduced driving device and effectively using the internal space of the apparatus.

Furthermore, the introduction unit, release unit, collection unit, and reject unit in the present banknote-handling apparatus are arranged at the diametral opposite side from the storage units with respect to the conveyance drum. In addition, the rotational direction of the conveyance drum during the conveyance of a banknote into any one of the storage units, and the rotational direction of the drum during the conveyance of a banknote into any one of the units arranged at the diametral opposite side from the storage units with respect to the conveyance drum, are also made opposite to each other. This makes it possible to lay out internal components of the apparatus in even more rational collective form, and to further miniaturize the entire apparatus.

In this apparatus, it is preferable that each of the storage units is configured to take one of a standby state in which the storage unit accepts a banknote to be stored, from the circling conveyance route through the associated interconnecting conveyance route, and a non-standby state other than the standby state; and the control unit is further configured to control the rotary driving device and the route changer such that if the storage unit associated with the banknote to be stored is in the non-standby state, a conveyance of the same banknote on the circling conveyance route is continued until the same storage unit has taken the standby state.

Thus, the apparatus can discriminate a received banknote with the discrimination sensor by moving the banknote from the introduction unit into the circling conveyance route without waiting for the storage unit to enter the standby state. Accordingly, rapid processing of the received banknote is possible.

In this apparatus, it is also preferable that the control unit is further configured to control the rotary driving device and the route changer such that if discrimination result on the received banknote by the discrimination sensor is abnormal, the rotational direction of the conveyance drum is changed from the forward direction to the reverse direction to move the same banknote into the reject unit.

Thus, the received banknote whose discrimination results by the discrimination sensor have been abnormal can be immediately moved as an unacceptable (reject) banknote into the reject unit. Even if an unacceptable banknote is detected, therefore, any effects upon the rapidness of received-banknote processing can be minimized.

There is also provided a banknote handling apparatus comprising:

a conveyance drum having a circumferential length greater than a length of a longest one of all kinds of banknotes to be handled;

a rotary driving device configured to rotate the conveyance drum in both forward and reverse directions;

a plurality of pressure rollers spaced in a circumferential direction of the conveyance drum, each of the rollers being pressed against an outer surface of the drum;

a circling guide member formed around the outer surface of the conveyance drum, the circling guide member forming a circling conveyance route between the drum and the guide member;

a discrimination sensor provided on the circling conveyance route, the discrimination sensor being configured to discriminate denominations of the banknote moved past the sensor;

a banknote introduction unit into which a received banknote is introduced:

a plurality of banknote storage units each for accommodating the received banknote of corresponding one or more of denominations;

a banknote release unit configured to release the banknote removed from at least one of the storage units in preparation for disbursement;

a banknote collection unit for accommodating the banknote collected from at least one of the storage units;

a reject unit for accommodating, of all the received banknotes and all the banknotes to be disbursed, only a banknote to be rejected as unacceptable one;

interconnecting guide members forming interconnecting conveyance routes connected between the circling conveyance route and the introduction unit, the storage units, the release unit, the collection unit, and the reject unit, respectively to convey a banknote therebetween;

a route changer configured to change an actual banknote conveyance route from/to the circling conveyance route to/from any one of the interconnecting conveyance routes;

a circling passage sensor provided on the circling conveyance route to sense the banknote moved past the circling passage sensor;

interconnection passage sensors each provided on corresponding one of the interconnecting conveyance routes connected to the respective storage unit to sense the banknote moved past the same interconnecting passage sensor; and a control unit configured to control at least the rotary driving device and the route changer, and to detect a banknote jam during conveyance based on outputs from the circling passage sensor and the interconnecting passage sensor;

wherein:

the introduction unit, the release unit, the collection unit, and the reject unit are arranged at an opposite side from the storage units with respect to the conveyance drum in a diametral direction of the conveyance drum; and the control unit is further configured to control the rotary driving device and the route changer, when detecting a jam of the received banknote, such that a rotating speed of the conveyance drum is reduced to clear the jam, and then the rotational direction of the conveyance drum is changed from the forward direction to the reverse direction to move the same banknote into the reject unit.

The introduction unit, release unit, collection unit, and reject unit in this banknote-handling apparatus are also arranged at the diametral opposite side from the storage units with respect to the conveyance drum. This arrangement, in turn, makes it possible to lay out internal components of the apparatus in even more rational collective form, and to further miniaturize the entire apparatus.

In addition, if a jam of a received banknote is detected in the present banknote-handling apparatus, a banknote conveyance force thereof that is generated by the conveyance drum can be increased in a relative fashion by reducing a rotating speed of the conveyance drum, to achieve more reliable release of the jam.

There is also provided a banknote handling apparatus comprising:

a conveyance drum having a circumferential length greater than a length of a longest banknote of all kinds of banknote to be handled, and smaller than twice a longitudinal dimension of the shortest banknote thereof;

a rotary driving device configured to rotate the conveyance drum in both forward and reverse directions;

a plurality of pressure rollers spaced in a circumferential direction of the conveyance drum, each of the rollers being pressed against an outer surface of the drum;

a circling guide member formed around the outer surface of the conveyance drum, the circling guide member forming a circling conveyance route between the drum and the guide member;

a discrimination sensor provided on the circling conveyance route, the discrimination sensor being configured to discriminate denominations of the banknote moved past the sensor;

a banknote introduction unit into which a received banknote is introduced:

a plurality of banknote storage units each for accommodating the received banknote of corresponding one or more of denominations;

a banknote release unit configured to release the banknote removed from at least one of the storage units in preparation for disbursement;

a banknote collection unit for accommodating the banknote collected from at least one of the storage units;

a reject unit for accommodating, of all the received banknotes and all the banknotes to be disbursed, only a banknote to be rejected as unacceptable one;

interconnecting guide members forming interconnecting conveyance routes connected between the circling conveyance route and the introduction unit, the storage units, the release unit, the collection unit, and the reject unit, respectively to convey a banknote therebetween;

a route changer configured to change an actual banknote conveyance route from/to the circling conveyance route to/from any one of the interconnecting conveyance routes, the route changer including an oscillating guide member provided at a branching position between the circling conveyance route and the interconnecting conveyance route connected to the reject unit, the oscillating guide member being configured to selectively guide the banknote to one of the circling conveyance route and the same interconnecting conveyance route;

a circling passage sensor provided on the circling conveyance route to sense the banknote moved past the circling passage sensor; and a control unit configured to control at least the rotary driving device and the route changer, and to detect an entry of two banknotes into the circling conveyance route and a circumferential spatial interval between the two banknotes, on the basis of an output from the circling passage sensor;

wherein:

the introduction unit, the release unit, the collection unit, and the reject unit are arranged at an opposite side from the storage units with respect to the conveyance drum in a diametral direction of the conveyance drum; and the control unit is further configured to control the rotary driving device and the route changer, when detecting the entry of the two banknotes into the circling conveyance route, such that:

(i) if the detected circumferential interval between the two banknotes is less than a minimum interval that makes it possible for the oscillating guide member to guide the banknote to the interconnecting conveyance route, the conveyance of the two banknotes on the circling conveyance route is continued, and (ii) if the detected circumferential interval between the two banknotes is at least the minimum interval, the rotational direction of the conveyance drum is changed from the forward direction to the reverse direction to move the two banknotes into the reject unit sequentially by means of a guidance to the interconnecting conveyance route by the oscillating guide member.

The introduction unit, release unit, collection unit, and reject unit in this banknote-handling apparatus are also arranged at the diametral opposite side from the storage units with respect to the conveyance drum. This arrangement, in turn, makes it possible to lay out internal components of the apparatus in even more rational collective form, and to further miniaturize the entire apparatus.

In addition, since the circumferential length of the conveyance drum is smaller than twice the length of the shortest banknote, if two banknotes are conveyed in catenated form into the circling conveyance route, one of the two banknotes will definitely overlap the other. Furthermore, if the circumferential interval between the two banknotes is less than the minimum interval mentioned above, the conveyance of both the banknotes along the circling conveyance route will be continued. During the continued conveyance, a difference in circumferential velocity between the overlapping banknotes will occur, which will change the circumferential interval therebetween and increase this interval to the minimum interval. In this case, the apparatus can move the two banknotes into the reject unit sequentially by rotating the conveyance drum in the reverse direction and guiding the two banknotes to the interconnecting conveyance route via the corresponding oscillating guide member.

BEST MODE FOR CARRYING OUT THE INVENTION

An embodiment of the present invention is described below referring to the accompanying drawings. More specifically, an overall configuration, route changer, banknote storage units, control system, total operation, operationally advantageous effects, and modifications of a banknote handling apparatus according to the present embodiment are described in that order. In the description of the route changer and the storage units, respective description items are further divided into sub-items, that is, a further detailed configuration, characteristic function and effect, and modifications.

{Overall Configuration}

First, the overall configuration of the banknote-handling apparatus for receiving and disbursing banknote is described referring to FIGS. 1 to 4.

Figure 1:
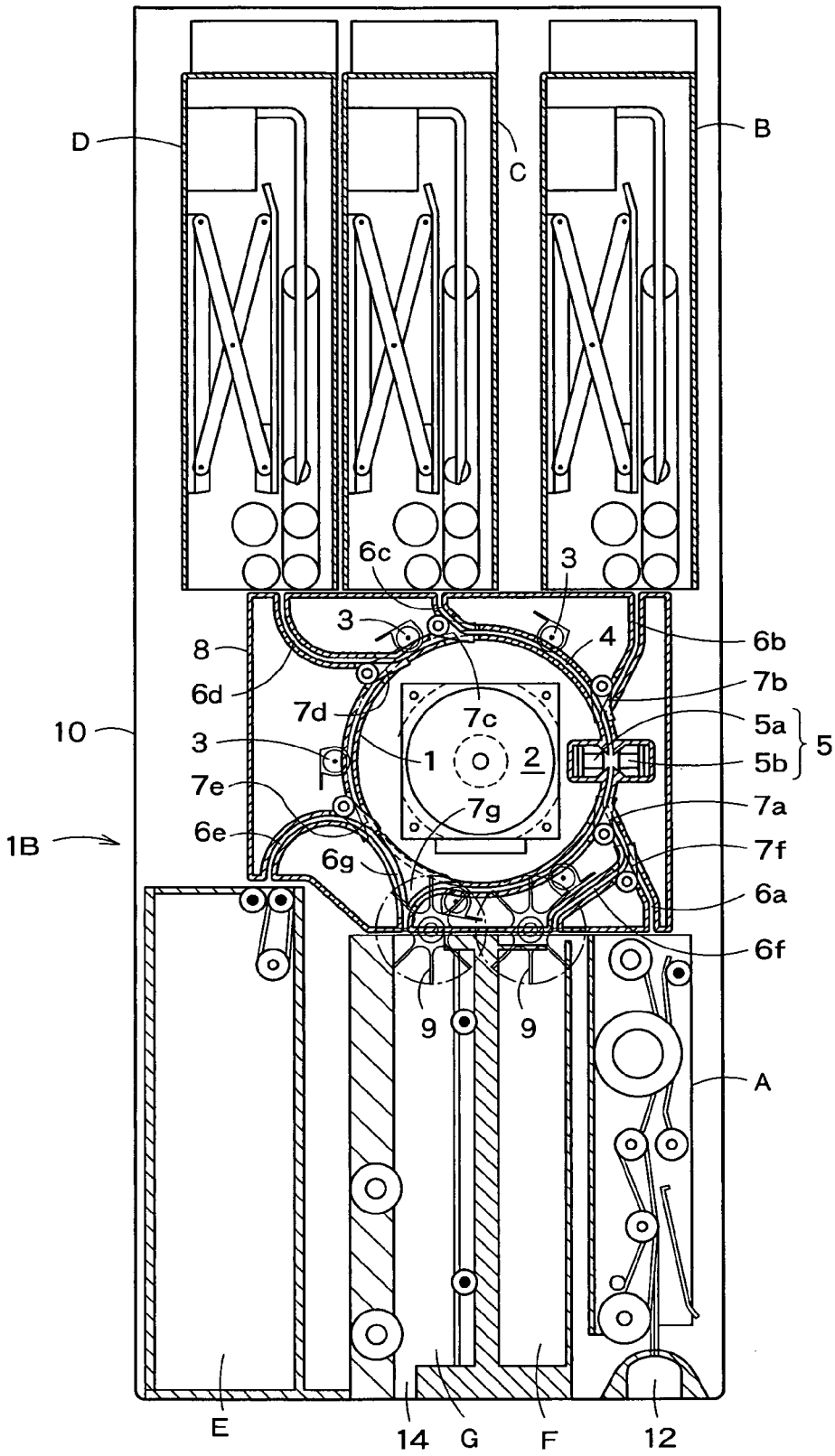
FIG. 1 is a horizontal, sectional view showing an embodiment of a banknote handling apparatus according to the present invention.
Figure 2:
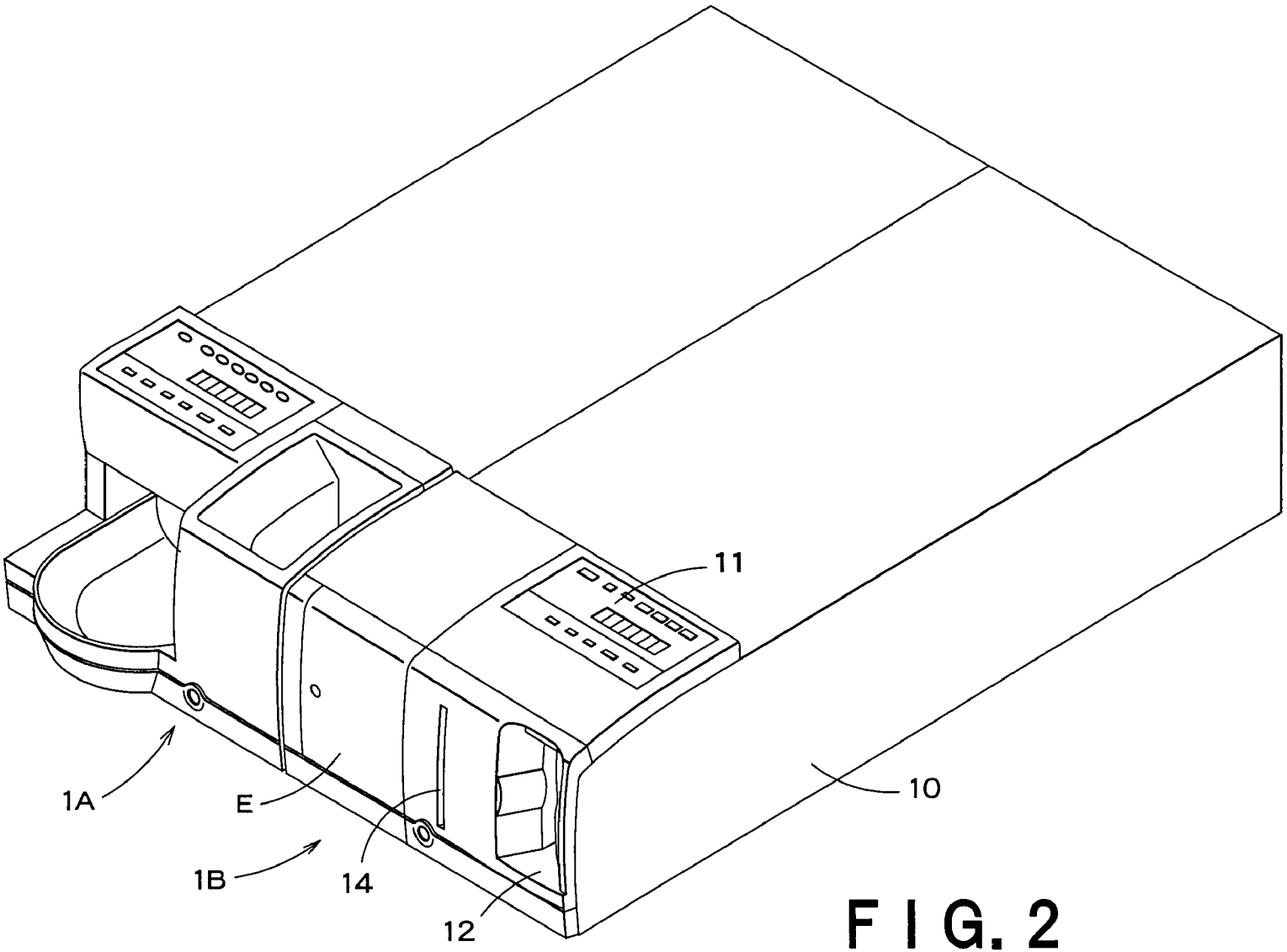
FIG. 2 is a perspective external view showing the apparatus of FIG. 1, combined with a coin handling apparatus.

The banknote handling apparatus 1B in FIG. 1 is used in combination with a coin handling apparatus 1A adapted to receive and disburse coins, as shown in FIG. 2, for example. In that case, the coin handling apparatus 1A and the banknote handling apparatus 1B are further combined with an external apparatus not shown, such as a POS register. Thus, the apparatus 1A and the apparatus 1B operate as a coin change dispenser and a banknote change dispenser, respectively.

As shown in FIG. 1, the banknote handling apparatus 1B has an approximately cylindrical conveyance drum 1 disposed with an axial line directed in a perpendicular direction substantially centrally in a housing 10. Also, a banknote introduction unit A, banknote storage units, B, C, D, a banknote collection unit E, a banknote release unit G, and a reject unit F are arranged inside the housing 10 so as to encircle an outer surface of the conveyance drum 1. Of all the above units, only the storage units B, C, D are arranged at a rear-panel side of the housing 10. The introduction unit A, the reject unit F, the release unit G, and the collection unit E are arranged near the housing 10 at an opposite side to the storage units B, C, D, in a diametral direction of the conveyance drum 1.

As shown in FIGS. 1 and 2, the front panel of the housing 10 has a banknote insertion slot 12 associated with the introduction unit A, and a banknote ejection slot 14 associated with the release unit G. The housing 10 also includes an exposed front panel of the collection unit E. The collection unit E is forward removable from the housing 10 by unlocking a key. The housing 10 further has a display operations unit 11 on an upper front face of the housing 10.

In FIG. 1, the introduction unit A acquires an incoming banknote that has been inserted into the banknote insertion slot 12, and delivers the inserted banknote to the conveyance drum 1. The storage units B, C, D are used to accommodate the inserted banknotes for each denomination thereof. These storage units are usually used as a 1,000-yen banknote storage unit B, a 2,000-yen/5,000-yen (mixed) banknote storage unit C, and a 10,000-yen banknote storage unit D. The release unit G is used to release an outgoing banknote that has been discharged from the storage units B, C, D, and make the discharged banknote removable from the banknote ejection slot 14.

The reject unit F is for accommodating a rejected banknote (described later herein). The collection unit E is used to accommodate banknotes that have been collected from the storage units B, C, and D. When either the storage unit B, C, D is full and cannot accommodate an associated incoming banknote, the collection unit E is also used to accommodate this banknote.

The introduction unit A, the release unit G, the reject unit F, and the collection unit E can use known or well-known constituent elements to form respective internal configurations, so a further detailed description of these units is omitted. The storage units B, C, D are described in detail as separate items.

Near the outer surface of the conveyance drum 1, a circling conveyance route 4 is formed to convey banknotes circularly. Interconnecting conveyance routes 6*a* to 6*g* for interconnecting the circling conveyance route 4 to the introduction unit A, the storage units B, C, D, the collection unit E, the reject unit F, and the release unit G, are also formed. The interconnecting conveyance routes 6*a* to 6*g* are constructed to branch at different branching positions from the circling conveyance route 4 and convey the banknote. The conveyance route 6*f*, however, branches from the conveyance route 6*g*.

A guide member 8 formed of a plate material is provided around the conveyance drum 1. The guide member 8 includes a circling guide member that works with the outer surface of the conveyance drum 1 to form the circling conveyance route 4, and an interconnecting guide member that forms each interconnecting conveyance route 6*a*-6*g*. A rubber impeller 9 for assisting in banknote stacking is provided at entrances of both the release unit G and reject unit F to which the interconnecting conveyance routes 6*g* and 6*f*, respectively, are connected.

A rightward section of the circling conveyance route 4 has a discrimination sensor 5 for discriminating denominations of the banknote moved along that section. The discrimination sensor 5 also functions as a circling passage sensor to detect a passage of the banknote on the circling conveyance route 4. The discrimination sensor 5 is constructed as an optical sensor, for example, and has two sensor components, 5*a* and 5*b*, arranged at positions opposed to each other across the circling conveyance route 4.

Figure 3:
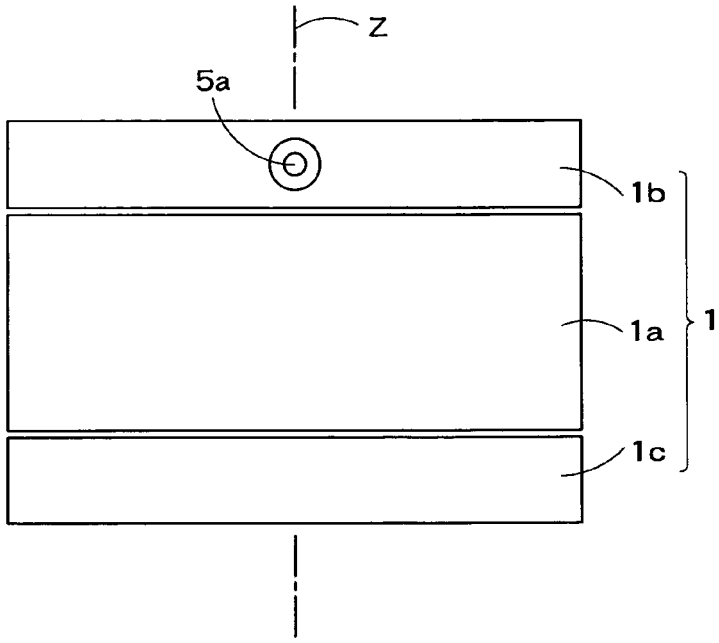
FIG. 3 is a right-side view of a conveyance drum in the apparatus of FIG. 1.

As shown in FIG. 3, the conveyance drum 1 includes a rotary drum 1*a*, an upper stationary drum 1*b*, and a lower stationary drum 1*c*, the upper and lower stationary drums being arranged adjacently at both sides of the rotary drum 1*a* in a direction of a Z-axial line with respect to the rotary drum 1*a*. The rotary drum 1*a* is adapted to be rotated in both forward (normal) and reverse directions by a rotary driving device 2 (shown in FIG. 1) that includes a motor. The stationary drums 1*b* and 1*c* are fixed with respect to the housing 10. The upper stationary drum 1*b* has the sensor component 5*a* embedded at a circumferential side of the drum. In this case, when the rotary drum 1*a* rotates in a counterclockwise direction in FIG. 1, the rotation of the rotary drum is the forward rotation, and when the drum rotates clockwise, the rotation thereof is the reverse rotation.

The conveyance drum 1 has a circumferential length (diameter) that is approximately common to the drums 1*a* to 1*c*. The circumferential length is set to be greater than length of the longest banknote handled (in this case, 10,000-yen banknotes), and smaller than twice a longitudinal dimension of the shortest banknote (in this case, 1,000-yen banknotes).

Also, height (Z-axial dimension) of the entire conveyance drum 1 is set to substantially fit widths of the banknote handled.

As shown in FIG. 1, the rotary driving device 2 is provided inside the conveyance drum 1. The rotary driving device 2 may be constructed to rotationally drive the rotary drum 1*a* directly with a motor or may be constructed to rotationally drive the rotary drum 1*a* via any speed reducer. In addition, a plurality of (in this case, five) pressure rollers 3 each resiliently pressed against an outer surface of the rotary drum 1*a* are spaced in a circumferential direction of the conveyance drum 1.

The banknote-handling apparatus 1B shown in FIG. 1 has a route changer that changes a conveyance route of a banknote between the circling conveyance route 4 and each interconnecting conveyance route 6*a*-6*g*. This route changer is disposed at a branching position between the interconnecting conveyance route 6*a*-6*g* and the circling conveyance route 4, and has guide members 7*a* to 7*g* that are each adapted to selectively guide the banknote to either the particular interconnecting conveyance route 6*a*-6*g* or the circling conveyance route 4. Configuration forms of the guide members 7*a*-7*g* are divided into oscillating guide members 7*a* to 7*f* associated with the interconnecting conveyance routes 6*a* to 6*f*, and a moving guide member 7*g* associated with the interconnecting conveyance route 6*g*.

The interconnecting conveyance route 6*f* is not directly connected to the circling conveyance route 4. Instead, the interconnecting conveyance route 6*f* is connected to the circling conveyance route 4 via the interconnecting conveyance route 6*a*. The oscillating guide member 7*f* is therefore provided at a branching portion between the interconnecting conveyance route 6*a* and the interconnecting conveyance route 6*f*. Also, a conveyance route change from the circling conveyance route 4 to the interconnecting conveyance route 6*f* via the oscillating guide member 7*f* is conducted in coordination with the oscillating guide member 7*a*.

Figure 4:
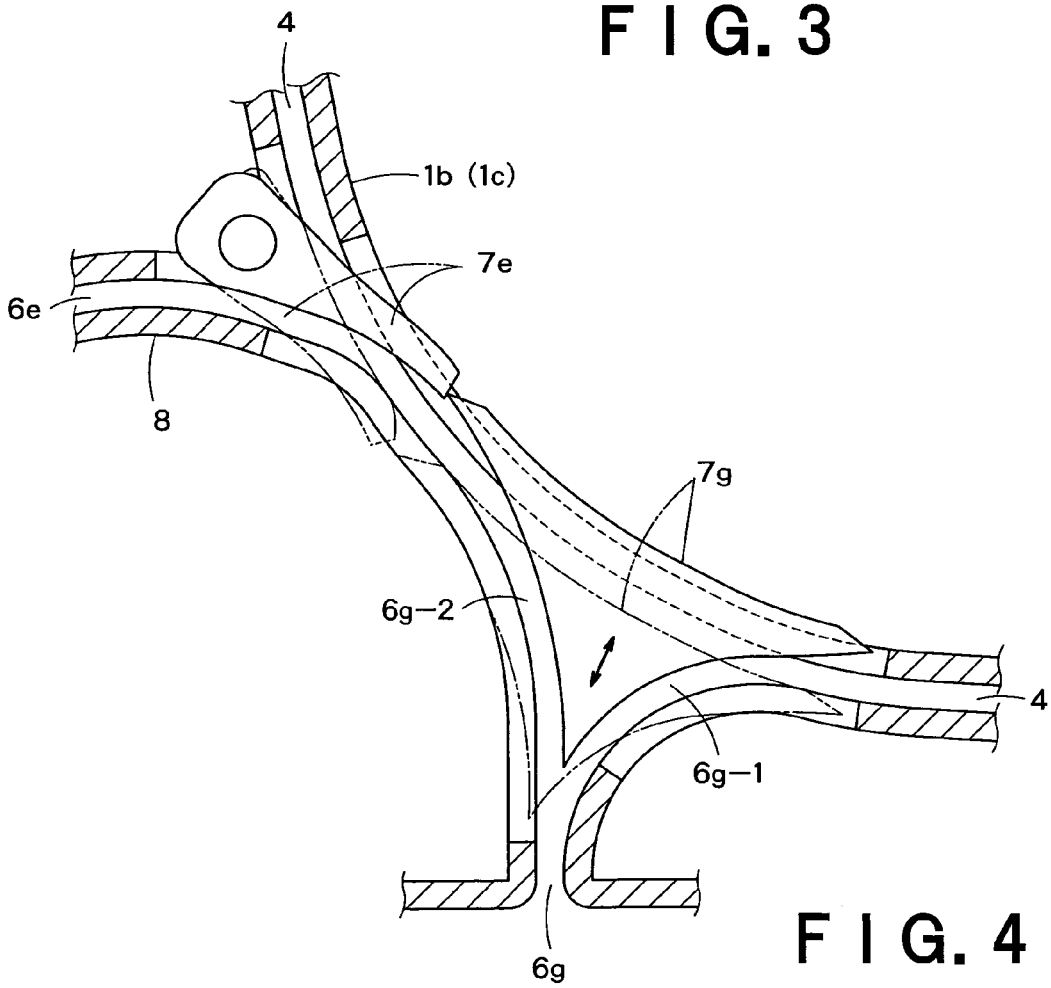
FIG. 4 is an enlarged view that shows one of oscillating guide members and a moving guide member in the apparatus of FIG. 1.

One oscillating guide member 7*e* and one oscillating guide member 7*g* are shown in enlarged view in FIG. 4. These guide members, 7*e* and 7*g*, are provided in association only with the stationary drums 1*b* and 1*c* of the conveyance drum configuration in FIG. 3, except the rotary drum 1*a*. Associated portions of the stationary drums 1*b*, 1*c* and guide member 8 are each notched (the same also applies to the guide members 7*a* to 7*d* and 7*f*).

The oscillating guide member 7*e* is adapted to change a conveyance route of a banknote from the circling conveyance route 4 to the interconnecting conveyance route 6*e* by oscillating from a "passing-side position" denoted as a double-dashed line in FIG. 4, to a "branching-side position" denoted as a solid line in FIG. 4. That is, the oscillating guide member 7*e* guides the banknote so that the banknote will head from the circling conveyance route 4 towards the interconnecting conveyance route 6*e*. Also, the moving guide member 7*g* is adapted to change a conveyance route of a banknote from the circling conveyance route 4 to the interconnecting conveyance route 6*g* by translating from the position denoted as a double-dashed line in FIG. 4, to the position denoted as a solid line.

The interconnecting conveyance route 6*g* is branched into an interconnecting conveyance route 6*g*-1 which permits an outgoing banknote to pass during the reverse rotation of the rotary drum 1*a*, and an interconnecting conveyance route 6*g*-2 which permits the banknote to pass during the forward rotation of the rotary drum 1*a*. For this banknote-handling apparatus, however, the interconnecting conveyance route 6*g*-2 becomes unnecessary since the apparatus is set such that as described later in the item of {Control system}, all banknotes are moved into the release unit G by the reverse rotation of the rotary drum 1*a*.

{Route Changer}

[Configuration]

Next, a more specific configuration of the route changer is described below referring primarily to FIGS. 5 and 6.

The description below relates to major sections of the route changer that are concerned particularly with the guide members 7*a* to 7*e*, except for the guide member 7*f*, of the route changer constituent elements shown in FIG. 1. FIG. 5 is a perspective view showing the major sections of the route changer. Also, FIG. 6 is a schematic diagram in which the circling conveyance route 4 extending in circular form is substituted by a linear conveyance route 4 to allow better understanding of operating principles of the route changer shown in FIG. 5.

As described in FIG. 4 taking the guide member 7*g* as an example, the oscillating guide members 7*a* to 7*e* are provided such that at the respective branching positions, these guide members each oscillate between the "branching-side position" at which the guide member guides a banknote so that the banknote will head from the circling conveyance route 4 towards each interconnecting conveyance route 6*a*-6*e*, and the "passing-side position" at which the guide member guides a banknote so that the banknote will move along the circling conveyance route 4. As shown in FIG. 5, each oscillating guide member 7*a*-7*e* is constructed of four jaw-shaped members 70. The four jaw-shaped members 70 are fixed in a state of alignment with one another with respect to an oscillating shaft 72 common to each.

The route changer also has an approximately disc-shaped pivoting coupler 120 which couples the oscillating guide members 7*a*-7*e* to one another for interlocking operative association thereof. The pivoting coupler 120 is provided so as to be able to turn about a pivotally axial line that passes through a central portion of the circularly shaped circling conveyance route 4 shown in FIG. 1 (i.e., the pivotally axial line agrees with the axial line Z in FIG. 3). In FIG. 6, the coupler 120 is depicted on the assumption that since the linear circling conveyance route 4 forms a linear moving pattern, the coupler also has a linear shape and translates.

Figure 5:
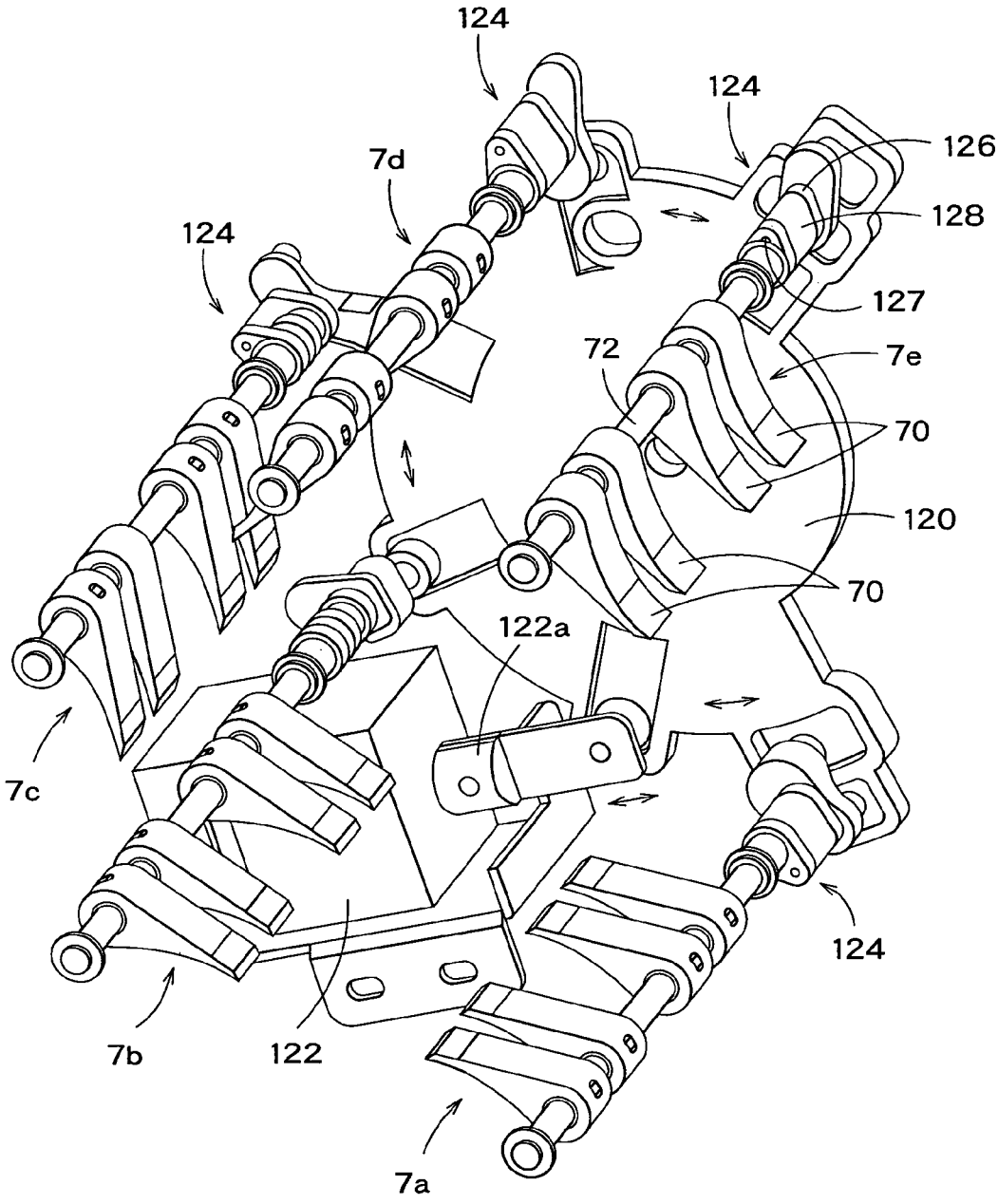
FIG. 5 is a perspective view that shows major sections of a route changer in the apparatus of FIG. 1.

The route changer also has an biasing member (not shown), such as a coil spring, for mechanically biasing the pivoting coupler 120 in the counterclockwise direction of FIG. 5. A return spring 129 is shown as an equivalent of the biasing member, in FIG. 6. In addition, the route changer has a straight-traveling type of unidirectional solenoid 122 as an actuator to cause the oscillation of each oscillating guide member 7*a*-7*e* via the coupler 120. The solenoid 122 has a plunger 122*a* whose front end engages with a groove of the coupler 120. The solenoid 122 is adapted so that by pulling the plunger 122*a* inward when electrically energized, the solenoid turns the coupler 120 in the clockwise direction of FIG. 5 (in FIG. 6, moves the coupler rightward) in defiance of an biasing force of the biasing member.

An idle mechanism 124 is interposed between the coupler 120 and each oscillating guide member 7*a*-7*e*. Each idle mechanism 124 is constructed of a first member 126 directly working in operative association with the coupler 120, a second member 127 directly working in operative association with the associated oscillating guide member 7*a*-7*e*, and a resilient member 128 interposed between the first member 126 and the second member 127.

In each idle mechanism 124 of FIG. 5, the first member 126 is a lever installed pivotably with respect to the oscillating shaft 72 (but, within a definite angle range), the lever having a front end formed to engage with the groove of the coupler 120. Similarly, the second member 127 is a lever locked against the oscillating shaft 72. The resilient member 128 is a plate spring member interposed between the two levers, 126 and 127, so as to act resiliently against relative pivotal movements of both levers.

Figure 6:
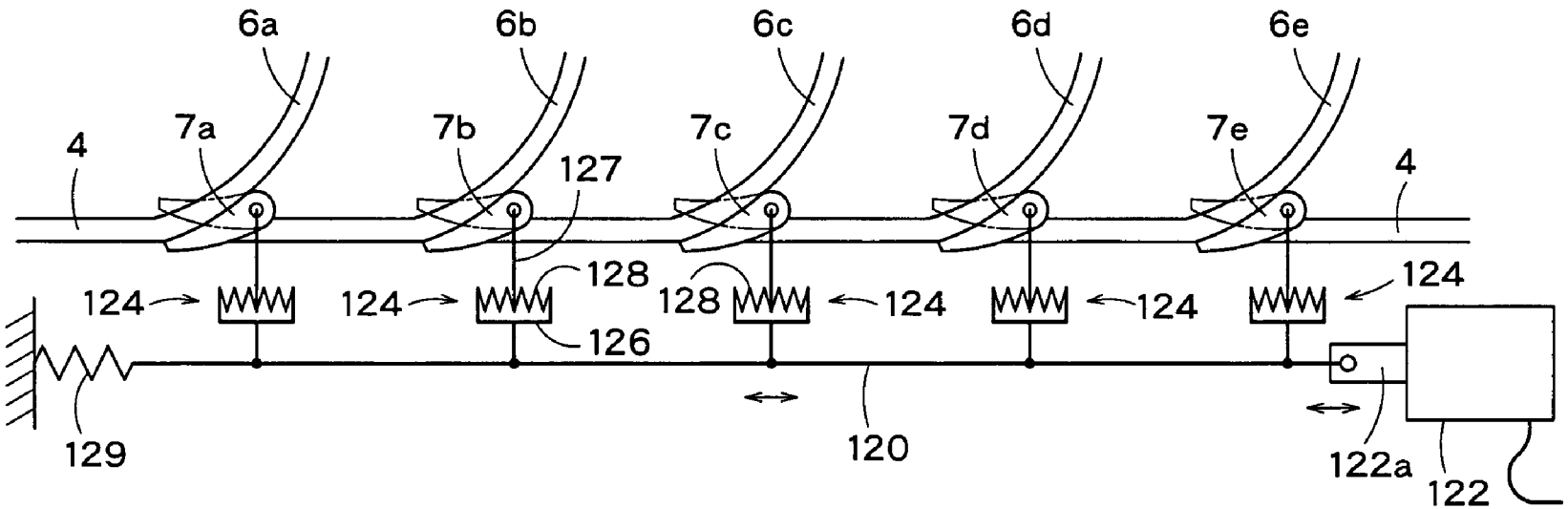
FIG. 6 is a schematic diagram that shows operating principles of the route changer of FIG. 5.

Thus, each idle mechanism 124 is constructed so that as shown in FIG. 6: at one hand, each oscillating guide member 7*a*-7*e* at the branching-side position can be made to idle towards the passing-side position while being mechanically biased towards the branching-side position, and at the other hand, each oscillating guide member 7*a*-7*e* at the passing-side position can be made to idle towards the branching-side position while being mechanically biased towards the passing-side position.

[Function And Effect]

Next, characteristic function and effect of the route changer constructed above are described below.

First, this route changer can use one actuator 122 to make the plurality of oscillating guide members 7*a*-7*e* work in operative association between the branching-side position and the passing-side position, via the coupler 120.

In this case, guiding a banknote at a specific branching position so that the banknote will head from the circling conveyance route 4 towards the branched conveyance routes 6*a*-6*e* can be accomplished by oscillating each guide member 7*a*-7*e* to the branching-side position when a leading edge of the banknote is present between the particular branching position and a branching position immediately previous thereto. At this time, even if any one of the guide members 7*a*-7*e* located upstream on the circling conveyance route 4 acts to hold down the banknote, the idle mechanism 124 ensures the passage of the banknote.

In addition, a banknote can be returned from either of the branched conveyance routes 6*a*-6*e* to the circling conveyance route 4 by oscillating each guide member 7*a*-7*e* to the passing-side position. At this time, even if any one of the guide members 7*a*-7*e* acts at the branching position and holds down the banknote, the idle mechanism 124 ensures the passage of the banknote.

In this way, the route changer that guides a banknote for heading from the circling conveyance route 4 towards any branched conveyance route 6*a*-6*e* can be constructed by using a smaller number of actuators 122 than the number of branches of the conveyance route (in the above case, one actuator 122). For this reason, the changer can be reduced in costs and dimensionally, compared with a apparatus that uses special actuators to oscillate the individual guide members 7*a* to 7*e* (therefore, this latter apparatus requires actuators as many as there actually are branches).

[Modification]

While operatively associating five oscillating guide members, 7*a* to 7*e*, by using one actuator 122 has been described above, a plurality of actuators may be used as necessary, if the particular number of actuators is smaller than that of oscillating guide members.

In addition, a mechanical biasing element equivalent to the return spring 129 shown in FIG. 6 can be omitted by using a bidirectional self-holding type solenoid or the like, instead of the unidirectional solenoid 122 functioning as the actuator. Furthermore, the straight-traveling type of solenoid as the actuator, can be substituted by, for example, a rotary solenoid, a motor, or any other type of actuator.

{Storage Units}

[Configuration]

Next, a configuration substantially common to the storage units B, C, and D, is described below, referring to FIGS. 7 to 10.

Figure 7:
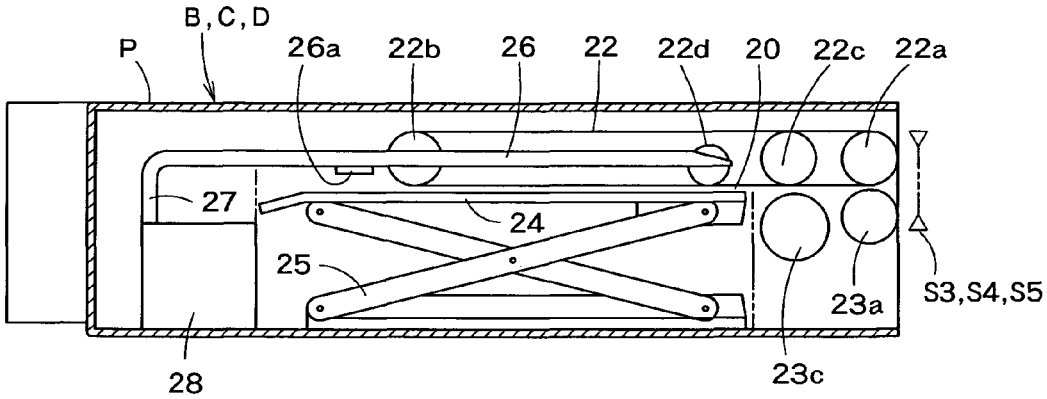
FIG. 7 is an enlarged view that shows one of storage units in the apparatus of FIG. 1.
Figure 9:
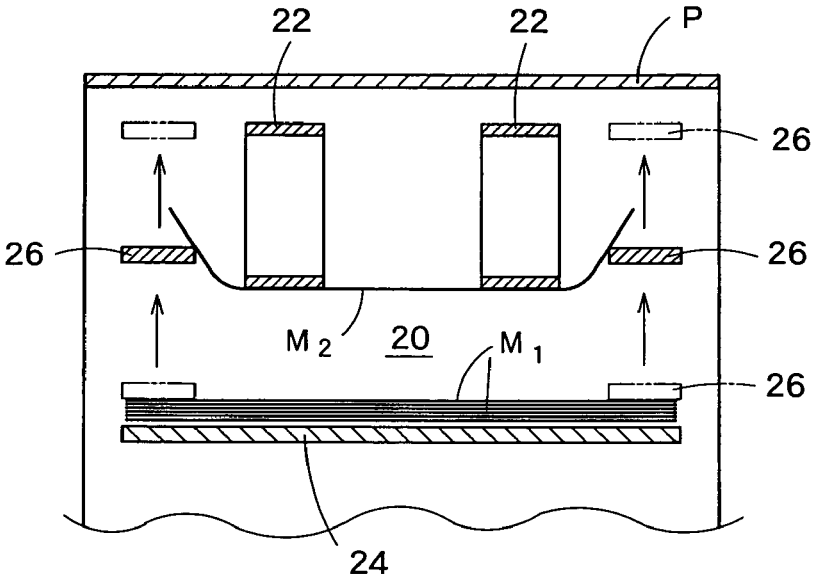
FIG. 9 is a cross-sectional view of essential elements, showing a state of the retaining member existing when it moves from the standby position to the escape position in the mechanism of FIG. 8.

As shown in FIG. 7, each storage unit has a storage section 20 inside a partition P which forms an outer edge of the storage unit B, C, D, wherein the storage section 20 can accommodate a banknote in a stacked condition. In this case, the banknote stored into the storage section 20 will be stacked horizontally (in FIG. 7, in a vertical direction) in a posture that makes a shorter edge of the banknote faces perpendicularly. As shown in FIG. 9, one pair of conveyance belts 22 spaced in the perpendicular direction are provided at one side (in FIG. 7, upper side) of the banknote existing when stacked in the storage section 20 (one side of the storage section 20 in the stacking direction of the banknotes stored therein).

Each conveyance belt 22 extends in a direction of a longer edge (in FIG. 7, lateral direction) of the banknote in the storage section 20. Each conveyance belt 22 is mounted between one set of pulleys 22*a*, 22*b*. A belt roller 22*c* and an auxiliary roller 22*d* are arranged between the pulleys 22*a*, 22*b*. Additionally, an opposed roller 23*a* and a gate roller 23*c* are arranged to be opposed to each pulley 22*a* and belt roller 22*c*.

Each storage unit B, C, D is positioned so that a portion thereof between the pulley 22*a* and the opposed roller 23*a* serves as an entrance/exit for the banknote, this entrance/exit leading to the associated interconnecting conveyance route 6*b*-6*d* shown in FIG. 1. At the entrance/exit, a passage sensor S3-S5 (see FIG. 7) is provided for detecting the passage of the banknote.

Figure 8:
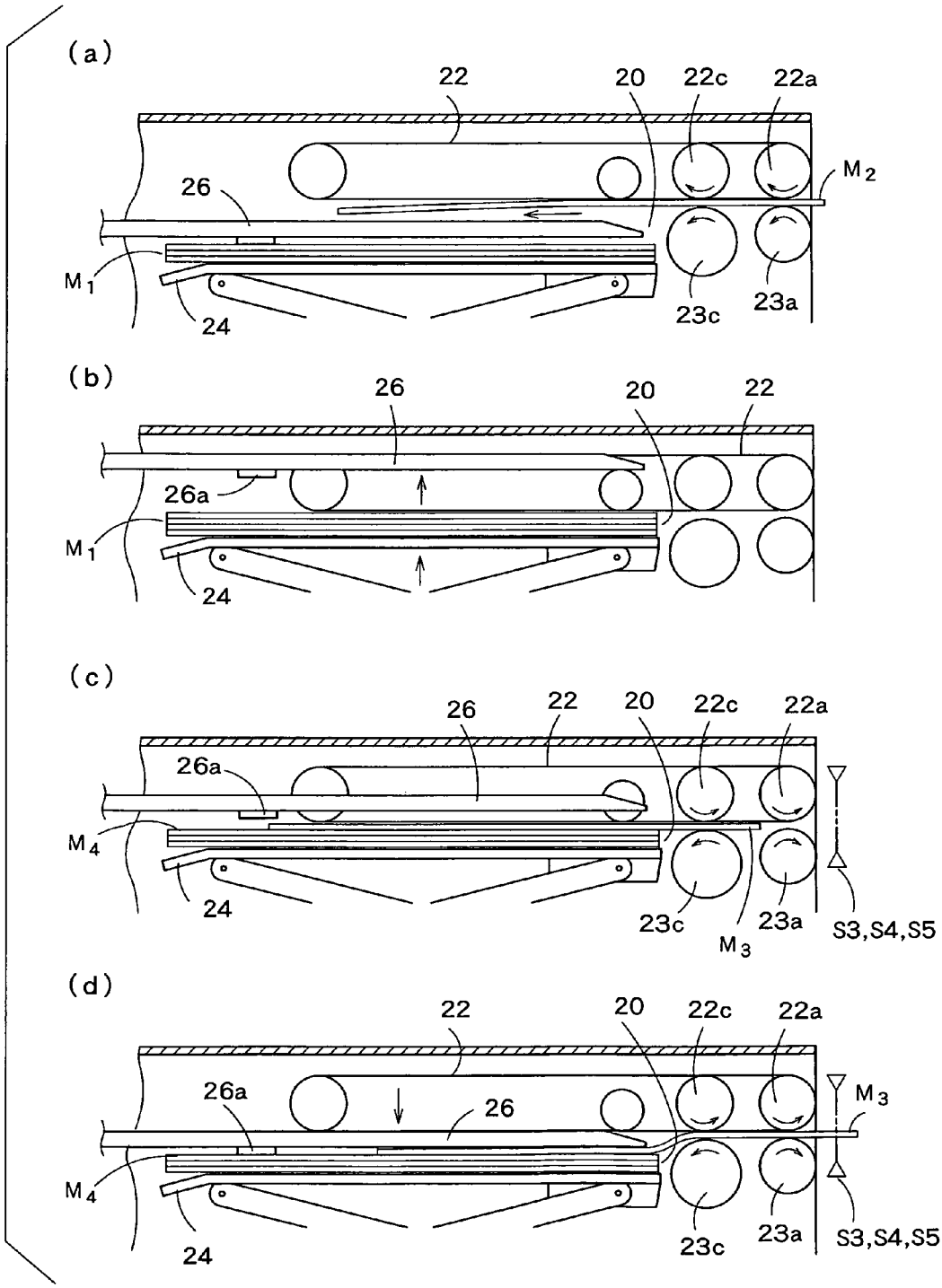
FIG. 8 shows enlarged views of one of the major sections in FIG. 7, indicating a retaining member in (a) standby position, (b) escape position, (c) delivering position, and (d) multi-sheet simultaneous conveyance preventing position.

The conveyance belt 22 is constructed as a conveying device adapted to, as shown in FIG. 8(*c*), abut the surface of the banknote $M_3$ present at the most anterior position in the stack of a banknote stored within the storage section 20, and deliver the same banknote $M_3$ in a delivering direction (rightward direction of FIG. 8(*c*)) that is approximately orthogonal to the stacking direction. Sections of the conveyance belt 22 that are associated with the pulley 22*a* and the roller 22*c*, the opposed roller 23*a*, and the gate roller 23*c* constitute a "feeder 22, 23*a*, 23*c*". As shown in FIG. 8(*a*), this feeder is provided to feed accepted a banknote $M_2$ into the storage section 20, and to further deliver outward the banknote $M_3$ that has been delivered by the conveyance belt 22. As shown in FIGS. 8C and 8D, however, the gate roller 23*c* rotates in a direction opposite to the direction in which the banknote $M_3$ has been delivered, and acts as a separator for the delivered banknote $M_3$. Thus, the gate roller 23*c* prompts separation of the delivered banknote $M_3$ from other banknote.

As shown in FIG. 7, a banknote-receiving member 24 having an approximately flat-plate shape is provided so as to be translatable in the stacking direction of the banknote, between the conveyance belt 22 and the other side (in FIG. 7, lower side) of the banknote in the stacking direction (the other side of the storage section 20 in the stacking direction of the banknotes stored therein). The receiving member 24 is mechanically biased towards the conveyance belt 22 via a link 25 by a spring not shown.

As shown in FIGS. 7 and 9, one pair of retaining members 26 extend approximately in parallel with respect to the delivering direction of the banknote, at a position where the conveyance belt 22 is present between the retaining members when viewed from the stacking direction of the banknote. Each retaining member 26 has a shape of a bar approximately rectangular in cross section, and as shown in FIG. 7, extends at a distal end nearly to an edge of the receiving member 24 at one end thereof. Also, a proximal end of the retaining member 26 extends over an edge of the receiving member 24 at the other end thereof. The proximal end of each retaining member 26 is connected to a coupler 27 extending to the other side (in FIG. 7, lower side) of the stacked banknotes in the stacking direction thereof. A frictional portion 26*a* slightly protruding over the receiving member 24 is provided near the proximal end of each retaining member 26. The frictional portion 26*a* has a surface (e.g., rubber surface) of a friction coefficient larger than that of the surface (e.g., smooth metallic surface or resin surface) of any other portion of the retaining member 26.

Figure 10:
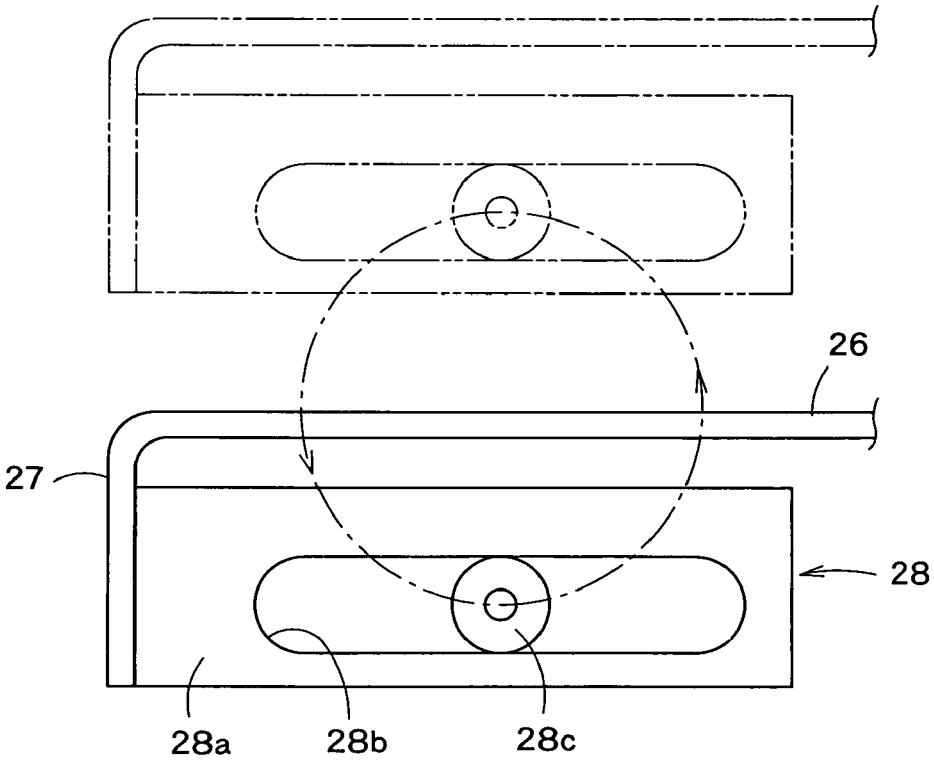
FIG. 10 is an enlarged view of the essential elements, illustrating a mechanism for moving the retaining member in the mechanism of FIG. 8.

The storage section 20 further has a shifter 28 to move the above pair of retaining members 26 in the stacking direction of the banknote. The shifter 28 has, as shown in FIG. 10, a follower 28*a* guided to translate in the stacking direction of the banknote, and a driving roller 28*c* for moving the follower 28*a*. The follower 28*a* has a rectangular hole 28*b* extending in flat-plate form from the coupler 27, in the same direction as that of the retaining member 26, and extending in one direction. The shifter 28 is constructed to revolve, as shown in FIG. 10, the driving roller 28*c* engaged with the rectangular hole 28*b* of the follower 28*a*, and consequently cause the paired retaining members 26 to translate in the stacking direction of the banknote. The driving roller 28*c* can be revolved if installed at such a position as on an outer surface of a disc (or at a distal end of an arm) rotationally driven by a motor or the like.

The paired retaining members 26 can be moved to any one of four positions, standby position (FIG. 8(*a*)), escape position (FIG. 8(*b*)), delivering position (FIG. 8(*c*)), and multi-sheet simultaneous conveyance preventing position (FIG. 8(*d*)), by the shifter 28.

Standby position (FIG. 8(*a*)): A position at which, as shown in FIG. 8(*a*), if a banknote $M_1$ already exists inside the storage section 20, the stored banknote $M_1$ is sandwiched between the receiving member 24 and the corresponding retaining member 26, and the banknote $M_2$ fed in by the feeder 22, 23*a*, 23*c*, can be accepted between the retaining member 26 and the conveyance belt 22.

Escape position (FIG. 8(*b*)): A position at which the retaining member 26 moves away towards the conveyance belt 22 such that both edges of the fed-in banknote $M_2$ has been temporarily flexed as in FIG. 9, then the retaining member 26 has moved past from the standby position, and as shown in FIG. 8(*b*).

Delivering position (FIG. 8(*c*)): A position at which, as shown in FIG. 8(*c*), when the banknote $M_3$ at the most anterior position in the stack of banknotes stored within the storage section 20 is delivered outward by the conveyance belt 22, the retaining member 26 has moved away towards the conveyance belt 22 to prevent the frictional portion 26*a* from abutting the banknote $M_3$ delivered.

Multi-sheet simultaneous conveyance preventing position (FIG. 8(*d*)): A position at which, as shown in FIG. 8(*d*), the retaining member 26 has moved closer to the receiving member 24 than to the delivering position so that the frictional portion 26*a* abuts a banknote $M_4$ present at a position next to that of the banknote $M_3$ being delivered outward.

Delivering position (FIG. 8(*c*)) is set to be closer to the receiving member 24 than escape position (FIG. 8(*d*)). This allows for the fact that when a plurality of banknotes are delivered, the retaining member 26 requires reciprocation between delivering position (FIG. 8(*c*)) and multi-sheet simultaneous conveyance preventing position (FIG. 8(*d*)).

A state in which the paired retaining members 26 are present at above standby position (FIG. 8(*a*)) in each storage unit B, C, D, is referred to as a "standby state" of the storage unit. A state in which the paired retaining members 26 are present at any position other than standby position (FIG. 8(*a*)), inclusive of escape position (FIG. 8(*b*)), delivering position (FIG. 8(*c*)), and multi-sheet simultaneous conveyance preventing position (FIG. 8(*d*)), in each storage unit B, C, D, is referred to as a "non-standby state" of the storage unit.

[Function And Effect]

Next, characteristic function and effect of the storage units constructed above are described below.

First for banknote storage, the feeder 22, 23*a*, 23*c* feeds incoming a banknote $M_2$ into an interspace between the conveyance belt 22 and the retaining member 26 when the retaining member 26 is in the standby position in FIG. 8(*a*). After that, the retaining member 26 is moved to the escape position shown in FIG. 8(*b*) (also, see FIG. 9), whereby the banknote $M_2$ is stored as a banknote $M_1$ into the storage section 20. In addition, the retaining member 26 is returned to the standby position shown in FIG. 8(*a*) and then the above operation sequence is repeated. This makes it possible to store plural banknotes in stacked form into the storage section 20 (more specifically, between the receiving member 24 and the retaining member 26).

For banknote delivering, the banknote $M_3$ at the most anterior position inside the storage section 20 is first delivered by the conveyance belt 22 with the retaining member 26 present at the delivering position shown in FIG. 8(*c*). This delivering operation is performed by the conveyance belt or the feeder 22, 23*a*, 23*c*. Next after the passage sensor S3-S5 has detected that a trailing edge of the outgoing banknote $M_3$ has moved past a region of the frictional portion 26*a*, the retaining member 26 is moved to multi-sheet simultaneous conveyance preventing position shown in FIG. 8(*d*). Thus, the frictional portion 26*a* of the retaining member 26 prevents the banknote $M_4$ at the next let-out position from being carried outward with the above outgoing banknote $M_3$. In addition, the retaining member 26 is returned to the delivering position shown in FIG. 8(*c*) and then the above operation sequence is repeated. This makes it possible to reliably deliver plural banknotes, one at a time.

The storage units in the present embodiment makes it possible for the functions of the banknote storage members, multi-sheet simultaneous conveyance preventing members, and driving sources for these members, in conventional storage units, to be replaced only with the functions of the retaining members 26 and shifter 28 used in the embodiment. In terms of a relationship between banknote storage and the configuration intended for the prevention of multi-sheet simultaneous conveyance, therefore, costs can be reduced and space efficiency improved.

[Modification]

The stacking direction of a banknote in the storage section 20 of the storage unit B, C, D, is not limited to the horizontal direction described above, and can be a perpendicular direction or any oblique direction.

In addition, the conveyance belt 22 may be replaced by any other conveying device such as a conveyance roller, and the opposed roller 23*a* and/or the gate roller 23*c* may be replaced by any other member having the similar function, such as a belt.

Furthermore, the above-described shifter 28 as the element for translating the retaining members 26, may be replaced by any other element such as an actuator which directly drives the translation of the retaining members 26.

{Control System}

Next, a configuration relating to a control system of the banknote handling apparatus is described below, referring primarily to FIGS. 11 and 12.

Figure 11:
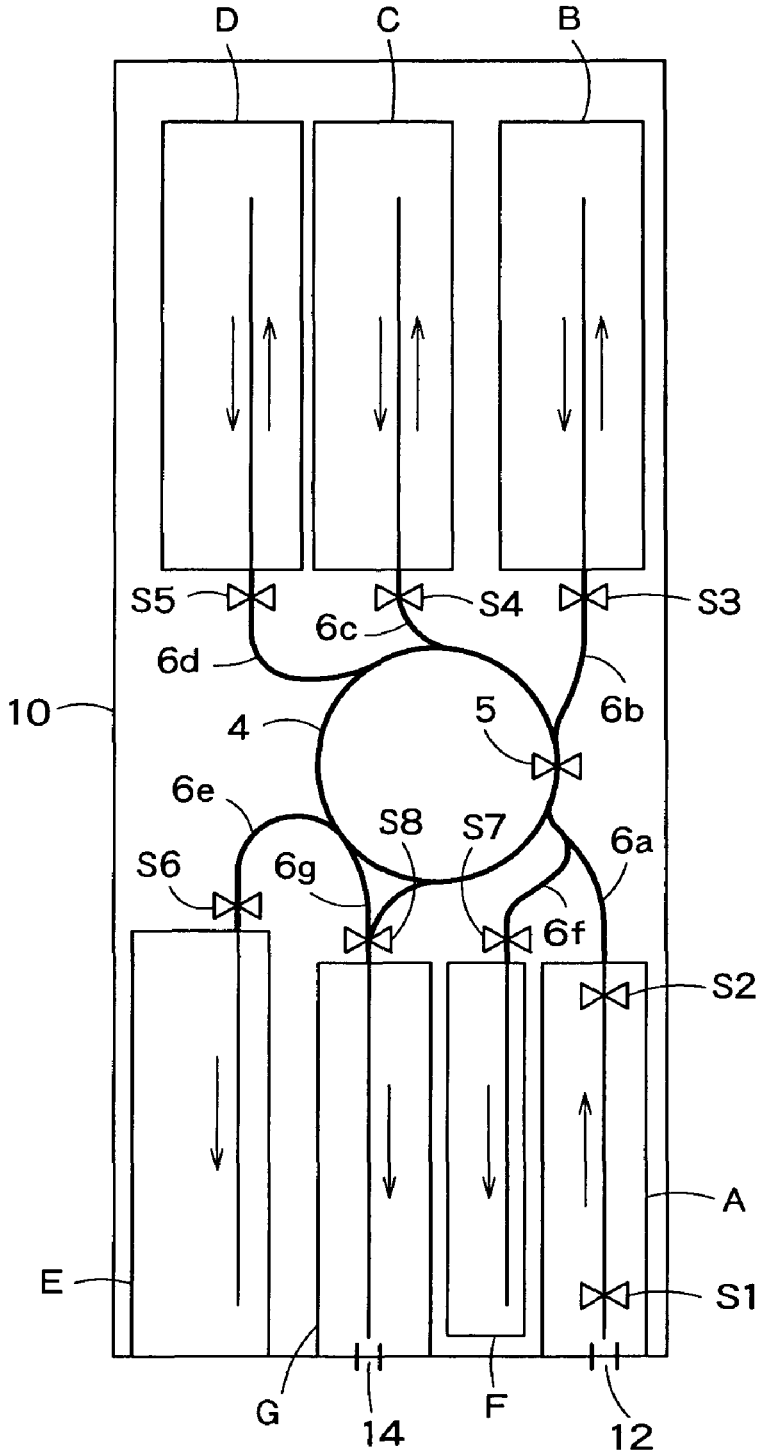
FIG. 11 is a schematic diagram that shows disposition of a sensor in the apparatus of FIG. 1.

As shown in FIG. 11, in addition to the discrimination sensor (circling passage sensor) 5, the banknote handling apparatus has passage sensors S1 to S8 constructed, for example, as optical sensors for detecting the passage of a banknote. Of all these sensors, only the sensors S1 and S2 provided in the introduction unit A sense the introduction of a banknote into the unit A and the delivery of a banknote therefrom. The other interconnections passage sensors S3 to S8 provided along the interconnecting conveyance routes 6*b* to 6*g* are arranged to detect passing a banknote in immediate front of the associated units B to G.

Figure 12:
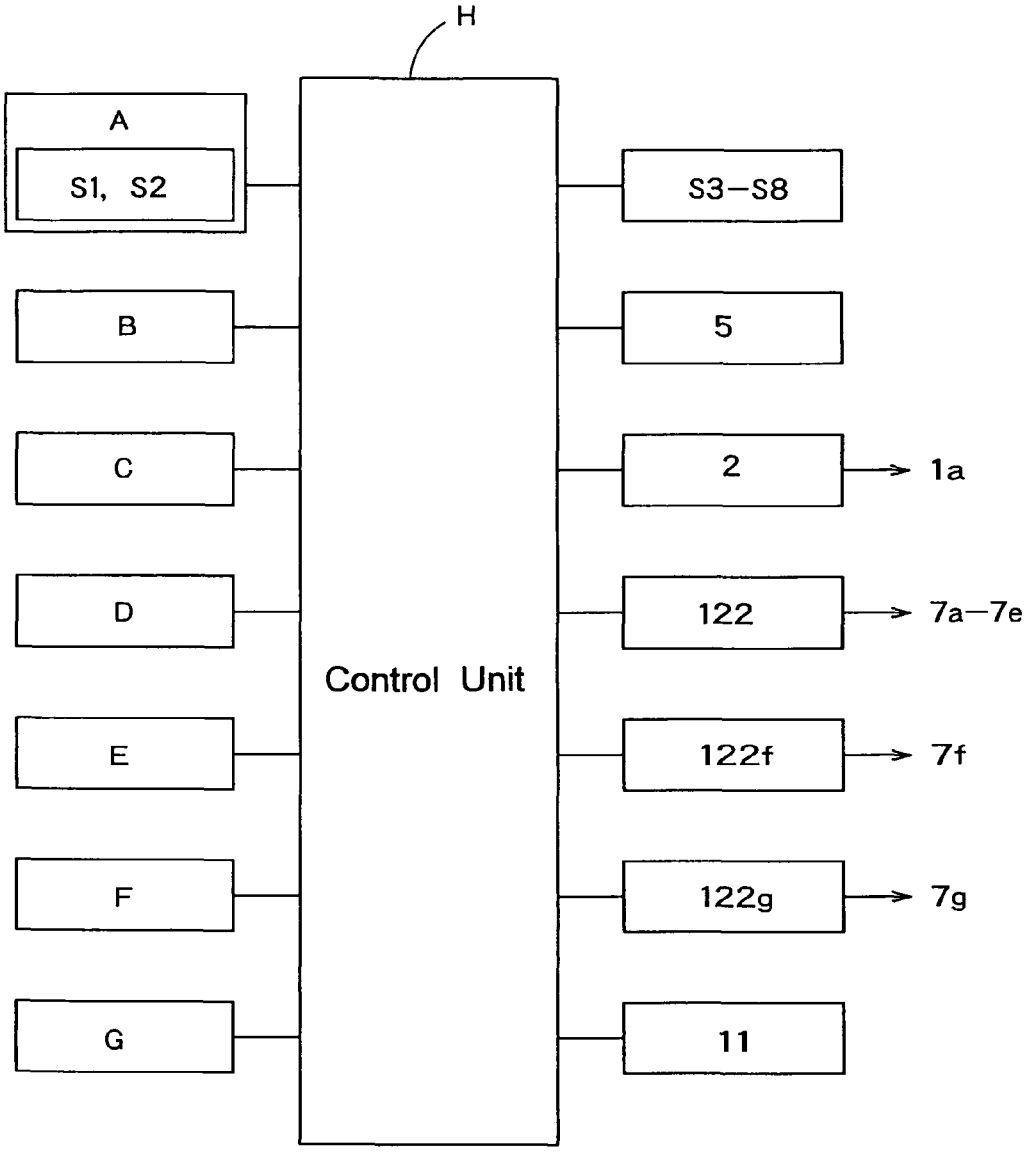
FIG. 12 is a block diagram of a control system in the apparatus of FIG. 1.

As shown in FIG. 12, the banknote handling apparatus has a control unit H to which the units A to G and the sensors S1 to S8 are connected. In addition, a rotary driving device 2 for the rotary drum 1*a*, an actuator 122 (see FIG. 5) for the oscillating guide members 7*a* to 7*e*, and a display operations unit 11 (see FIG. 2) are connected to the control unit H. Furthermore, actuators (e.g., solenoids) 122*f* and 122*g* for the oscillating guide member 7*f* and the moving guide member 7*g* are connected to the control unit H. Thus, the control unit H is able not only to control the rotation of the rotary drum 1*a* via the rotary driving device 2, but also to control the operation of the route changer via the actuators 122, 122*f*, and 122*g*.

Moreover, the control unit H is constructed to have at least the following functions:

(1) First, the control unit H controls the rotary driving device 2 so as to:

(i) rotate the rotary drum 1*a* in forward direction to move a banknote into either of the storage units B to D, and (ii) rotate the rotary drum 1*a* in reverse to move a banknote into either the release unit G, the collection unit E, or the reject unit.

(2) Next if the storage unit B, C, D into which the banknote is to be stored is in the "non-standby state", the control unit H controls the rotary driving device 2 and the route changer so that the conveyance of the banknote on the circling conveyance route 4 will be continued until the storage unit has entered the "standby state".

(3) Furthermore, if received banknote discrimination results by the discrimination sensor 5 are abnormal, the control unit H changes the rotational direction of the rotary drum 1*a* from the forward direction to the reverse direction and controls the rotary driving device 2 and the route changer so that the banknote will be moved as unacceptable banknote into the reject unit F.

(4) Next, on the basis of outputs from the circling passage sensor (discrimination sensor) 5 and from the interconnections passage sensors S3 to S8, the control unit H checks for a banknote jam during conveyance. If the jam is detected, the control unit H reduces a rotating speed of the rotary drum 1*a*, then after clearing the jam, rotates the drum 1*a* in reverse, and controls the rotary driving device 2 and the route changer so that the corresponding banknote will be moved into the reject unit F.

(5) Next, on the basis of an output from the circling passage sensor 5, the control unit H scans for entry of two banknotes into the circling conveyance route 4 and detects a circumferential spatial interval L (see FIG. 13) between the two banknotes. After detecting the entry of the two banknotes, the control unit H controls the rotary driving device 2 and the route changer so that:

(i) if the detected circumferential interval L between the two banknotes is less than a minimum interval Lm (see FIG. 14) that makes it possible for the oscillating guide member 7*a* to guide the banknote to the interconnecting conveyance route 6*a*, the conveyance of the two banknotes on the circling conveyance route 4 will be continued, or (ii) if the detected circumferential interval L between the two banknotes is equal to or greater than the minimum interval Lm, the rotary drum 1*a* will rotate in reverse and the two banknotes will be sequentially guided to the interconnecting conveyance route 6*a*, 6*f* by the oscillating guide member 7*a*, 7*f*, and moved into the reject unit F.

{Total Apparatus Operation}

Next, operation of the entire banknote handling apparatus is described below taking an example of using this apparatus as a banknote change dispenser controlled under a state in which the dispenser is connected to a POS register not shown.

(1) Receiving Banknote

First, a banknote that has been received from a customer as a payment for a purchase is inserted into the banknote insertion slot 12 (see FIGS. 1 and 2) in the form of a pack by an operator. The banknote that has thus been inserted from the insertion slot 12 is delivered, sheet by sheet, from the banknote introduction unit A of FIG. 1 through the interconnecting conveyance route 6*a* to the circling conveyance route 4 (by a publicly known banknote-separating/delivering mechanism). The banknote, after being delivered to the circling conveyance route 4, is conveyed along the circling conveyance route 4 in accordance with the forward rotation of the rotary drum 1*a*. During the conveyance, the banknote remains sandwiched between the conveyance drum 1 and each pressure roller 3.

While the banknote is being conveyed through one full circuit along the circling conveyance route 4, denominations of the banknote are discriminated by the discrimination sensor 5 and the banknote is stored into the storage units B, C, D appropriate for the discriminated denominations. Storage of the received banknote into each storage unit B, C, D is conducted by conveyance route changes from the circling conveyance route 4 to the interconnecting conveyance routes 6*b*, 6*c*, 6*d* by the associated guide members 7*b*, 7*c*, 7*d*. If the denominations discrimination by the discrimination sensor 5 fails for reasons such as skewing or other unusual movements of the banknote on the circling conveyance route 4, the corresponding banknote can be made to circle the circling conveyance route 4 once again to allow re-discrimination by the discrimination sensor 5 (so-called discrimination retrial).

During the banknote-receiving operation described above, the received sum based on the discrimination results is notified from the banknote handling apparatus to the POS register. The POS register, after being notified of the received sum, compares an purchase price of the customer-purchased commodity, entered during bar code reading, for example, and the received sum, and judges whether a differential occurs that is to be reimbursed as change. If the change occurs, a change pay-out instruction is notified from the POS register to the banknote-handling apparatus.

(2) Disbursing Banknote

After receiving the above-mentioned change pay-out instruction, the banknote handling apparatus disburses banknote, depending on the amount of change specified in the instruction. Examples of banknote disbursements are listed below. Only the 1,000-yen banknote storage unit B or the 2,000-yen/5,00-yen banknote storage unit C is associated with the disbursing operation based on the banknote pay-out instruction, and the 10,000-yen banknote storage unit is excluded.

(2-1) For a Change of 3,000 Yen

In this case, three 1,000-yen banknotes are delivered, one at a time, from the 1,000-yen banknote storage unit B through the interconnecting conveyance route 6*b* to the circling conveyance route 4 (by a publicly known banknote-separating/delivering mechanism). The banknote, after being delivered to the circling conveyance route 4, is conveyed along the circling conveyance route 4 in accordance with the reverse rotation of the rotary drum 1*a*, and the banknote is sent to the release unit G by a conveyance route change from the circling conveyance route 4 to an interconnecting conveyance route 6*g*-1 (see FIG. 4) by the associated guide member 7*g*. Upon receiving the three 1,000-yen banknotes, the release unit G releases the banknotes in the form of a pack from the banknote ejection slot 14 (via a publicly known mechanism) to such an extent that the banknotes protrude from the ejection slot 14. The banknotes that have protruded from the ejection slot 14 are removed by the operator.

In this case, since only 1,000-yen banknotes are stored into the 1,000-yen banknote storage unit B, the banknotes to be disbursed do not have the respective dominations discriminated by conveying each banknote through more than one full circuit along the circling conveyance route 4.

(2-2) For a Change of 7,000 Yen

In this case, one banknote only is first delivered from the 2,000-yen/5,000-yen banknote storage unit C in the reverse rotational direction of the conveyance drum 1, along the circling conveyance route 4. This banknote, after undergoing the denominations discrimination with the discrimination sensor 5 while circling the circling conveyance route 4 one time, is sent to the release unit G as in above case (2-1).

If a denomination of the first banknote delivered is 5,000 yen, two 1,000-yen banknotes are delivered as the remaining 2-000 yen from the 1,000-yen banknote storage unit B, and as in above case (2-1), the two banknotes are sent to the release unit G without being subjected to the denominations discrimination with the discrimination sensor 5.

Next, if the denomination of the first banknote delivered is 2,000 yen, only a second banknote is delivered from the 2,000-yen/5,000-yen banknote storage unit C and subjected to the denominations discrimination on the circling conveyance route 4. If the denomination of the second banknote is 5,000 yen, the disbursing operation is completed when the 5,000-yen banknote is sent to the release unit G. If the denomination of the second banknote is 2,000 yen, this 2,000-yen banknote is sent to the release unit G. In addition, three 1,000-yen banknotes are delivered as the remaining 3-000 yen from the 1,000-yen banknote storage unit B and sent to the release unit G without being subjected to denominations discrimination.

(3) Collecting Banknote

If, despite a full state of either of the storage units B, C, D, banknotes of an associated denomination are further received, the received banknotes are stored from the circling conveyance route 4 through the interconnecting conveyance route 6*g* into the collection unit E. After business hours for the day, when all banknotes are to be collected from the storage units B, C, D, the banknotes delivered therefrom are sequentially stored from the circling conveyance route 4 through the interconnecting conveyance route 6*g* into the collection unit E. The banknote that has been collected and stored into the collection unit E can be removed from the housing 10 by unlocking the key of the collection unit.

(4) Rejecting Banknote

If received banknotes include a banknote whose discrimination results by the discrimination sensor 5 have been abnormal for reasons such as dirtiness or damage, the particular banknote is sent as unacceptable one from the circling conveyance route 4 through the interconnecting conveyance routes 6*a*, 6*f* into the reject unit F, as described previously. If a banknote to be disbursed includes one whose discrimination results by the discrimination sensor 5 have been abnormal for reasons such as skewing or other unusual movements, the particular banknote is also sent as unacceptable one from the circling conveyance route 4 through the interconnecting conveyance routes 6*a*, 6*f* into the reject unit F.

{Function And Effect}

Next, function and effect of the banknote handling apparatus constructed above are described below.

As described previously, rotation of the conveyance drum 1*a* by the rotary driving device 2 allows the banknote handling apparatus of the present embodiment to convey a banknote along the circling conveyance route 4 while supporting the banknote in sandwiched form between the conveyance drum 1 and the pressure rollers 3. Also, the denominations of the banknote conveyed along the circling conveyance route 4 can be discriminated by using the discrimination sensor 5. In addition, the banknote can be selectively conveyed between the units A to G by changing the conveyance route of the banknote from the circling conveyance route to each interconnecting conveyance route 6*a*-6*g*, or vice versa, via the route changer.

Conveying a banknote in this manner using the conveyance drum 1 and the pressure rollers 3 does not cause such a tensile load as applied in the belt type of conveyance, and makes it unnecessary to use the high-output driving device employed in the conventional apparatus. In addition, regarding the requirement that the length of the conveyance route between the discrimination sensor 5 and the storage unit B, C, D be greater than the length of the "longest banknote" conveyed, banknote discrimination with the discrimination sensor 5 in the annular circling conveyance route 4 allows an internal space of the apparatus to be used more effectively than the conventional discrimination of a banknote in the linear conveyance route. Compared with the conventional apparatus, therefore, the apparatus according to the present invention allows the miniaturization of the entire apparatus by adopting the dimensionally reduced driving device 2 and effectively using the internal space of the apparatus.

Furthermore, the introduction unit A, release unit G, collection unit E, and reject unit F in the present banknote-handling apparatus are arranged at the opposite side with respect to the storage units B to D, in the diametral direction of the conveyance drum 1. Moreover, as described in item (1) of {Control system}, the rotational direction of the rotary drum 1*a* during the conveyance of a banknote into either of the storage units B, C, D, and the rotational direction of the drum 1*a* during the conveyance of a banknote into either of the units A, E, F, G arranged at the opposite side with respect to the storage units, in the diametral direction of the conveyance drum 1, are also made opposite to each other. This makes it possible to lay out internal constituent elements of the apparatus in even more streamlined, collective form, and to further miniaturize the entire apparatus.

Moreover, as described in item (2) of {Control system}, if the storage unit B, C, or D into which the banknote is to be stored is in the "non-standby state", conveyance of the banknote on the circling conveyance route 4 is continued until the particular storage unit has entered the "standby state". Thus, the apparatus can discriminate a received banknote with the discrimination sensor 5 by moving the banknote from the introduction unit A to the circling conveyance route 4 without waiting for the storage unit B, C, D to enter the standby state. Accordingly, more rapid processing of the received banknote is possible.

Moreover, as described in item (3) of {Control system}, if discrimination results on received a banknote by the discrimination sensor 5 are abnormal, the rotational direction of the rotary drum 1*a* is changed from the forward direction to the reverse direction and the banknote is sent to the reject unit F.

Thus, a received banknote whose discrimination results have been abnormal can be immediately moved as an unacceptable banknote into the reject unit F. Even if an unacceptable banknote is detected, therefore, any effects upon the rapidness of received-banknote processing can be minimized.

Moreover, as described in item (4) of {Control system}, if a jam in the movement of a received banknote is detected, the jam is cleared by reducing the rotating speed of the rotary drum 1*a* and then the banknote is moved into the reject unit F by rotating the drum 1*a* in reverse. In this way, reducing the rotating speed of the rotary drum 1*a* causes a relative increase in banknote-conveying force of the drum 1*a,* thus making more reliable clearing of the jam.

Figure 13:
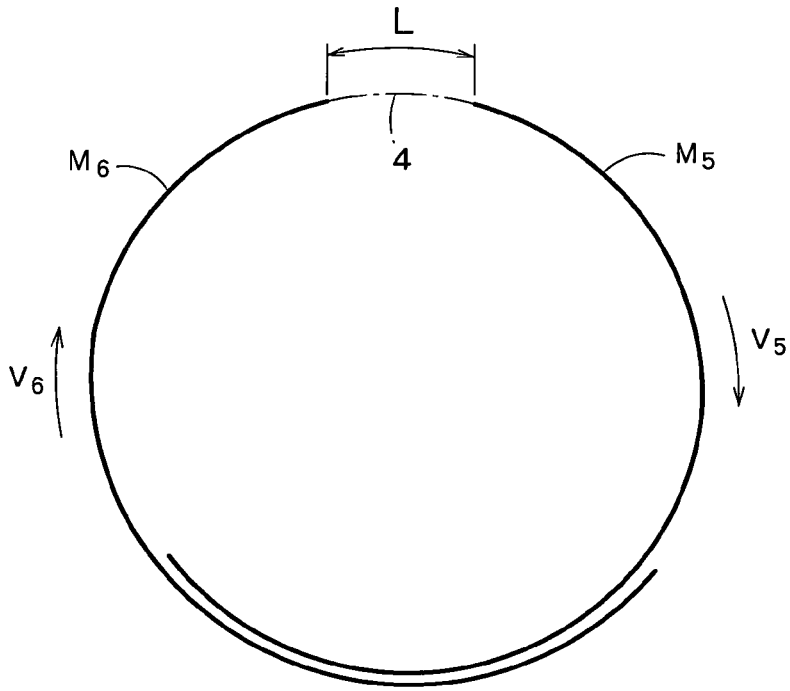
FIG. 13 is a schematic diagram showing a state in which two banknotes are supplied to a circling conveyance route in the apparatus of FIG. 1.

Moreover, in the banknote-handling apparatus, since the circumferential length of the conveyance drum 1 (circling conveyance route 4) is smaller than twice a longitudinal dimension of the shortest banknote, if, as shown in FIG. 13, two banknotes M5 and M6, are conveyed in catenated form into the circling conveyance route 4, one sheet of banknote, $M_5$ or $M_6$, will definitely overlap the other sheet. Furthermore, as described in item (5) of {Control system}, if the circumferential interval L (see FIG. 13) between the two banknotes detected is less than the minimum interval Lm (see FIG. 14), the conveyance of both banknotes M5 and M6, along the circling conveyance route 4 is continued.

Figure 15:
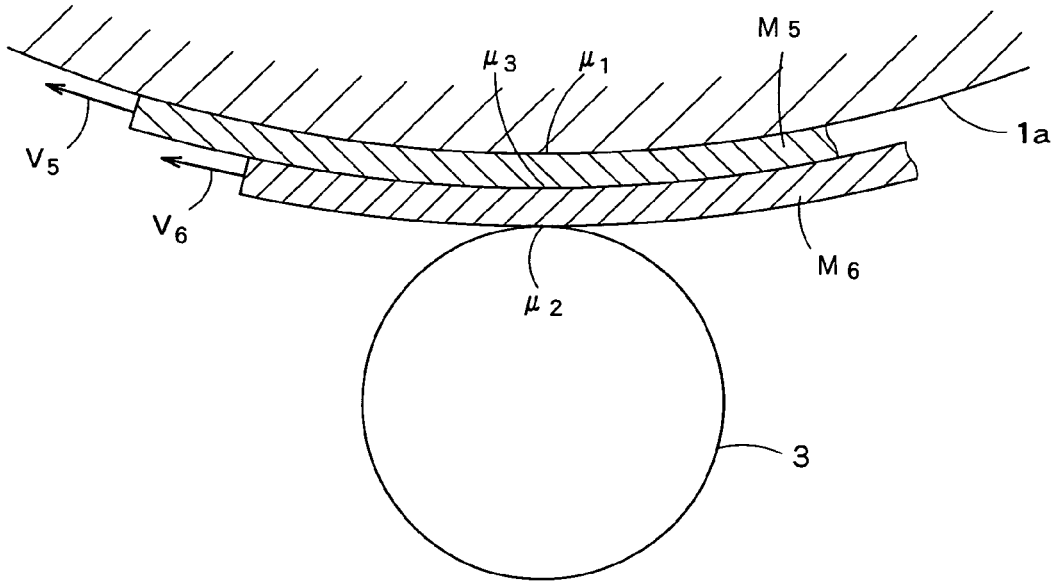
FIG. 15 is a horizontal, sectional view that represents in enlarged form a relationship between the two banknotes in FIG. 13, the conveyance drum, and a pressure roller.

During the continued conveyance, a difference between circumferential velocities $V_5$ and $V_6$ of the overlapping banknotes M5 and M6, changes the circumferential interval L therebetween and increases the circumferential interval to the minimum interval Lm. More specifically, as shown in FIG. 15, a frictional coefficient $\mu_1$ between the inner banknote $M_5$ and the rotary drum 1*a,* a frictional coefficient $\mu_2$ between the outer banknote $M_6$ and the pressure roller 3, and a frictional coefficient $\mu_3$ between the two banknotes M5 and M6, lie in relationships of $\mu_3<\mu_1$ and $\mu_3<\mu_2$. Accordingly, a slip occurs between the overlapping banknotes M5 and M6, and the velocity $V_5$ of the inner banknote $M_5$ tends to increase above the velocity $V_6$ of the outer banknote $M_6$.

When the circumferential interval L consequently detected between the two banknotes is equal to or greater than the minimum interval Lm, the two banknotes M5 and M6, can be sequentially guided to the interconnecting conveyance route 6*a,* 6*f* via the oscillating guide members 7*a,* 7*f,* and moved into the reject unit F. FIG. 13 shows the rotary drum 1*a* rotating in reverse from its initial phase, but if the rotary drum 1*a* is rotating in the forward direction, the apparatus will reverse the rotation of the drum 1*a* to move the two banknotes M5 and M6, into the reject unit F.

Figure 14:
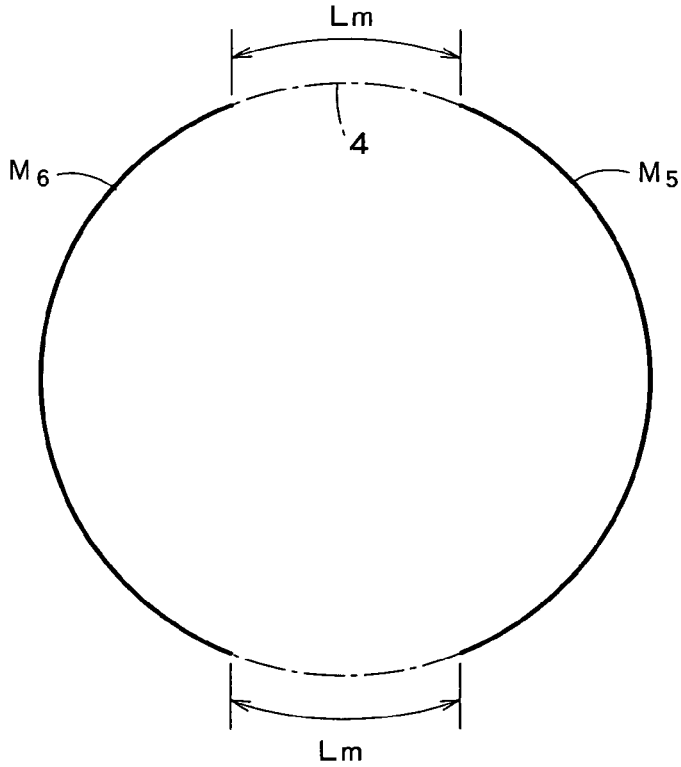
FIG. 14 is a diagram that assumes a conveyance drum (circling conveyance route) whose circumferential length is exceedingly greater than that of the conveyance route shown in FIG. 13.

Incidentally, for example, if the circumferential length of the conveyance drum 1 (circling conveyance route 4) is, as shown in FIG. 14, equal to or greater than twice the [length of the longest banknote+minimum interval Lm], the wider of the two intervals between the two banknotes, shown in FIG. 14, will always be equal to or greater than the minimum interval Lm. In this case, the conveyance drum 1 will be too large, which will result in departure from the present invention's spirit and point of miniaturizing the entire apparatus.

{Modification}

(1) While an example in which, as shown in FIG. 1, the interconnecting conveyance route 6*f* connected to the reject unit F is branched from the interconnecting conveyance route 6*a* has been described, the interconnecting conveyance route 6*f* may be connected directly to the circling conveyance route 4. In this case, the oscillating guide member 7*f* can be provided between the interconnecting conveyance route 6*f* and the circling conveyance route 4 and built into the operative associating mechanism shown in FIGS. 5 and 6.

(2) As set forth above, the interconnecting conveyance route 6*g*-2 shown in FIG. 4 can be omitted. In this case, in lieu of the moving guide member 7*g* that translates, essentially the same oscillating guide member 7*g* as other oscillating guide members 7*a* to 7*f* can be provided. This oscillating guide member 7*g* can also be built into the operative associating mechanism shown in FIGS. 5 and 6.

(3) A portion or all of the guide members 8 shown in FIG. 1 can be substituted by a belt or a roller.

(4) The introduction unit A, the release unit G, the collection unit E, and the reject unit F can each be arranged at any position at the side opposite to the storage units B to D, in the diametral direction of the conveyance drum 1. For example, the positions of the release unit G and the reject unit F may be transposed.

(5) While an example in which the banknote handling apparatus handles the 1,000-yen, 2,000-yen, 5,000-yen, and 10,000-yen banknotes as currencies issued by the Japanese Government has been described, denominations of applicable banknote can be set arbitrarily to include foreign currencies. Any number of storage units can also be set. In addition, for example, a 2,000-yen banknote storage unit and a 5,000-yen banknote storage unit can be provided separately, in which case, the denominations discrimination during banknote disbursements, described above, becomes unnecessary.

The invention claimed is:

1. A banknote handling apparatus comprising:

a circling conveyance route having a circumferential length greater that a length of a longest one of all kinds of banknotes to be handled, configured to convey a banknote in both forward and reverse directions;

a discrimination sensor provided on the circling conveyance route, the discrimination sensor being configured to discriminate denominations of the banknote moved past the sensor;

a banknote introduction unit into which a received banknote is introduced:

a plurality of banknote storage units each for accommodating the received banknote of corresponding one or more of denominations;

a banknote release unit configured to release the banknote removed from at least one of the storage units in preparation for disbursement;

interconnecting conveyance routes connected between the circling conveyance route and the banknote introduction unit, the banknote storage units, and the banknote release unit, respectively to convey a banknote therebetween;

a route charger configured to change an actual banknote conveyance route from/to the circling conveyance route to/from any one of the interconnecting conveyance routes; and a control unit configured to control at least the conveyance direction of the circling conveyance route and the route changer;

wherein:

the introduction unit, the release unit are arranged at an opposite side from the storage units with respect to the circling conveyance route in a diametral direction of the circling conveyance route; and the control unit is further configured to control the conveyance direction of the circling conveyance route such that:

(i) when feeding the banknote into any one of the storage units, the banknote is conveyed by the circling conveyance route in forward direction, and (ii) when feeding the banknote into the release unit, the banknote is conveyed by the circling conveyance route in the reverse direction, wherein:

each of the storage units is configured to take one of a standby state in which the storage unit accepts a banknote to be stored, from the circling conveyance route through the associated interconnecting conveyance route, and a non-standby state other than the standby state; and the control unit is further configured to control the circling conveyance route and the route changer such that if the storage unit associated with the banknote to be stored is in the non-standby state, a circling conveyance of the same banknote on the circling conveyance route is repeated until the same unit has taken the standby state.

2. The banknote handling apparatus according to claim 1, further comprising a reject unit for accommodating, of all the received banknotes and all the banknotes to be disbursed, only a banknote to be rejected as unacceptable, wherein: p1 the control unit is further configured to control the circling conveyance route and the route changer such that if a discrimination result on a received banknote by the discrimination sensor is abnormal, the conveyance direction of the circling conveyance route is changed from the forward direction to the reverse direction to move the same banknote into the reject unit.

3. The banknote handling apparatus according to claim 1, wherein the circling conveyance route includes:

a conveyance drum having a circumferential length greater than a length of a longest one of all kinds of banknotes to be handled;

a rotary driving device configured to rotate the conveyance drum in both forward and reverse directions;

a plurality of pressure rollers spaced in a circumferential direction of the conveyance drum, each of the rollers being pressed against an outer surface of the drum; and a circling guide member formed around the outer surface of the conveyance drum, the circling guide member forming the circling conveyance route between the drum and the guide member.

4. The banknote handling apparatus according to claim 1, wherein the circling conveyance route has a circumferential length smaller than twice the length of the shortest one of all the kinds of banknotes to be handled.

5. The banknote handling apparatus according to claim 1, wherein the route changer comprises a coupler, which coupler is configured to couple a plurality of guide members to one another for interlocking operative association; and the guide members are configured to operate between open positions, for opening a connecting passage between the circling conveyance route and an interconnecting conveyance route, and closed positions, for closing a connecting passage between the circling conveyances route and an interconnecting conveyance route.

6. A banknote handling apparatus comprising:

a circling conveyance route having a circumferential length smaller than twice the length of the shortest one of all the kinds of banknotes to be handled, and configured to convey a banknote in both forward and reverse directions;

a discrimination sensor provided on the circling conveyance route, the discrimination sensor being configured to discriminate denominations of the banknote moved past the sensor;

a banknote introduction unit into which a received banknote is introduced:

a plurality of banknote storage units each for accommodating the received banknote of corresponding one or more of denominations;

a banknote release unit configured to release the banknote removed from at least one of the storage units in preparation for disbursement;

interconnecting conveyance routes connected between the circling conveyance route and the banknote introduction unit, the banknote storage units, and the banknote release unit, respectively to convey a banknote therebetween;

a route changer configured to change an actual banknote conveyance route from/to the circling conveyance route to/from any one of the interconnecting conveyance routes; and a control unit configured to control at least the conveyance direction of the circling conveyance route and the route changer;

wherein:

the introduction unit and the release unit are arranged at an opposite side from the storage units with respect to the circling conveyance route in a diametric direction of the circling conveyance route; and the control unit is further configured to control the conveyance direction of the circling conveyance route such that:

(i) when feeding the banknote into any one of the storage units, the banknote is conveyed by the circling conveyance route in the forward direction, and (ii) when feeding the banknote into the release unit, the banknote is conveyed by the circling conveyance route in the reverse direction, wherein:

each of the storage units is configured to take one of a standby state in which the storage unit accepts a banknote to be stored, from the circling conveyance route through the associated interconnecting conveyance route, and a non-standby state other than the standby state; and the control unit is further configured to control the circling conveyance route and the route changer such that if the storage unit associated with the banknote to be stored is in the non-standby state, a circling conveyance of the same banknote on the circling conveyance route is repeated until the same storage unit has taken the standby state.

7. The banknote handling apparatus according to claim 6, further comprising a reject unit for accommodating, of all the received banknotes and all the banknotes to be disbursed, only a banknote to be rejected as unacceptable, wherein:

the control unit is further configured to control the circling conveyance route and the route changer such that if a discrimination result on a received banknote by the discrimination sensor is abnormal, the conveyance direction of the circling conveyance route is changed from the forward direction to the reverse direction to move the same banknote into the reject unit.

8. The banknote handling apparatus according to claim 6, wherein the circling conveyance route includes:

a conveyance drum having a circumferential length smaller than twice the length of the shortest one of all the kinds of banknotes to be handled;

a rotary driving device configured to rotate the conveyance drum in both forward and reverse directions;

a plurality of pressure rollers spaced in a circumferential direction of the conveyance drum, each of the rollers being pressed against an outer surface of the drum; and a circling guide member formed around the outer surface of the conveyance drum, the circling guide member forming the circling conveyance route between the drum and the guide member.

9. The banknote handling apparatus according to claim 6, further comprising:

a rotary drum configured for conveying banknotes along the circling conveyance route at varying rotating speeds; and at least one passage sensor for detecting the passage of a banknote, wherein the control unit is further configured to determine if there is a banknote jam based on an output of the passage sensor, and, when it is determined that there is a jam, adjust the rotating speed of the circling conveyance route to thereby clear the jam.

10. The banknote handling apparatus according to claim 6, wherein the route changer comprises a coupler, which coupler is configured to couple a plurality of guide members to one another for interlocking operative association; and the guide members are configured to operate between open positions, for opening a connecting passage between the circling conveyance route and an interconnecting conveyance route, and closed positions, for closing a connecting passage between the circling conveyances route and an interconnecting conveyance route.

* * * * *